US010400456B2

(12) United States Patent
Krause

(10) Patent No.: US 10,400,456 B2
(45) Date of Patent: Sep. 3, 2019

(54) POLYMER-BASED BRACKET SYSTEM FOR EXTERIOR CLADDING

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 1 day.

(21) Appl. No.: 15/595,134

(22) Filed: May 15, 2017

(65) Prior Publication Data

US 2017/0247882 A1 Aug. 31, 2017

Related U.S. Application Data

(63) Continuation of application No. 15/415,068, filed on Jan. 25, 2017, now Pat. No. 10,202,775, which is a (Continued)

(51) Int. Cl.

| | |
|---|---|
| ***E04F 13/08*** | (2006.01) |
| ***E04F 13/12*** | (2006.01) |
| ***E04C 2/20*** | (2006.01) |
| ***E04B 1/61*** | (2006.01) |
| ***E04C 2/24*** | (2006.01) |
| ***E04B 1/76*** | (2006.01) |

(Continued)

(52) U.S. Cl.

CPC ..... *E04F 13/0821* (2013.01); *E04B 1/61* (2013.01); *E04B 1/7629* (2013.01); *E04C 2/243* (2013.01); *E04C 2/388* (2013.01); *E04F 13/0817* (2013.01); *E04F 13/0828* (2013.01); *E04F 13/12* (2013.01); *E04B 2001/405* (2013.01); *E04C 2/20* (2013.01); *E04F 13/07* (2013.01); *E04F 13/08* (2013.01); *E04F 13/081* (2013.01); *E04F 13/0801* (2013.01); *E04F 13/0803* (2013.01)

(58) Field of Classification Search

USPC ..... 52/407.3, 235, 506.06, 483.1, 846, 848, 52/837; D25/119, 121, 125, 127

See application file for complete search history.

(56) References Cited

U.S. PATENT DOCUMENTS

| | | | | |
|---|---|---|---|---|
| 421,820 | A * | 2/1890 | Davy | B65G 9/008 104/109 |
| 3,120,036 | A * | 2/1964 | Minds, Jr. | E06B 7/082 454/281 |

(Continued)

FOREIGN PATENT DOCUMENTS

| | | | |
|---|---|---|---|
| CA | 2924064 | A1 | 3/2015 |
| RU | 2112114 | C1 | 5/1998 |
| WO | 2010057273 | A1 | 5/2010 |

*Primary Examiner* — Robert Canfield

(74) *Attorney, Agent, or Firm* — Jovan N. Jovanovic; The Watson IP Group, PLC

(57) ABSTRACT

A system for supporting exterior panels or cladding units on a building substrate. The system includes a plurality of polymeric bracket members, wherein each of the polymeric bracket members further includes an anchor section, adapted to be coupled to the building substrate, and a support section adapted to couple to the exterior cladding unit. In assembly, as disposed between the building substrate and the exterior cladding units, the polymeric bracket members provide a thermal break from the exterior cladding units to the building substrate.

13 Claims, 20 Drawing Sheets

Related U.S. Application Data continuation of application No. 15/067,966, filed on Mar. 11, 2016, now Pat. No. 9,580,904, which is a continuation of application No. PCT/US2014/055118, filed on Sep. 11, 2014, which is a continuation of application No. 14/281,949, filed on May 20, 2014, now Pat. No. 9,151,052, which is a continuation-in-part of application No. 13/763,915, filed on Feb. 11, 2013, now Pat. No. 8,833,025, which is a continuation-in-part of application No. 12/984,051, filed on Jan. 4, 2011, now Pat. No. 8,826,620.

(51) Int. Cl.

| | |
|---|---|
| ***E04C 2/38*** | (2006.01) |
| *E04B 1/38* | (2006.01) |
| *E04F 13/07* | (2006.01) |

(56) References Cited

U.S. PATENT DOCUMENTS

| | | | | | |
|---|---|---|---|---|---|
| 3,223,209 | A | * | 12/1965 | Skromeda | E04B 2/766 403/263 |
| 3,436,885 | A | * | 4/1969 | Rothermel | E04B 2/62 52/207 |
| 3,486,288 | A | * | 12/1969 | Pyne | E06B 3/08 52/844 |
| 3,690,079 | A | * | 9/1972 | Hemminger | E04B 2/965 428/573 |
| 3,881,287 | A | * | 5/1975 | Biebuyck | E06B 1/38 52/127.1 |
| 3,940,899 | A | * | 3/1976 | Balinski | E04B 2/7411 52/481.1 |
| D242,625 | S | * | 12/1976 | Schmidt | D25/121 |
| D242,799 | S | * | 12/1976 | Schmidt | D25/121 |
| 4,040,219 | A | * | 8/1977 | Budich | E06B 3/22 52/204.591 |
| D246,889 | S | * | 1/1978 | Eckerline | D25/121 |
| D248,823 | S | * | 8/1978 | Eckerline | D25/121 |
| 4,586,841 | A | * | 5/1986 | Hunter | E04B 9/127 403/230 |
| D337,470 | S | * | 7/1993 | Hsu | D6/580 |
| 5,423,154 | A | * | 6/1995 | Maylon | E04F 13/06 52/364 |
| 5,706,620 | A | * | 1/1998 | De Zen | E04B 1/12 52/220.2 |
| 5,930,966 | A | * | 8/1999 | Wood | E04G 11/10 249/189 |
| 6,098,364 | A | | 8/2000 | Liu | |
| D736,954 | S | * | 8/2015 | Krause | D25/119 |
| 9,151,052 | B2 | * | 10/2015 | Krause | E04F 13/0828 |
| D772,433 | S | * | 11/2016 | Krause | D25/119 |
| D780,329 | S | * | 2/2017 | Li | D25/119 |
| D780,942 | S | * | 3/2017 | Krause | E04B 1/7629 D25/119 |
| D780,943 | S | * | 3/2017 | Krause | D25/119 |
| D780,944 | S | * | 3/2017 | Krause | D25/119 |
| D781,459 | S | * | 3/2017 | Krause | D25/119 |
| D781,460 | S | * | 3/2017 | Krause | D25/119 |
| D782,707 | S | * | 3/2017 | Krause | D25/119 |
| 9,617,739 | B2 | * | 4/2017 | Krause | E04F 13/0817 |
| D787,709 | S | * | 5/2017 | Krause | D25/119 |
| 9,879,419 | B2 | * | 1/2018 | Krause | E04B 2/58 |
| D824,046 | S | * | 7/2018 | Krause | E04F 13/0828 D25/119 |
| 2003/0019184 | A1 | * | 1/2003 | Habicht | E06B 3/273 52/846 |
| 2004/0031230 | A1 | * | 2/2004 | Pabedinskas | E04C 3/28 52/839 |
| 2007/0068111 | A1 | * | 3/2007 | Buntain | E04B 1/7612 52/699 |
| 2007/0137134 | A1 | * | 6/2007 | Plagemann | B29C 70/52 52/656.9 |
| 2011/0067332 | A1 | * | 3/2011 | Plagemann | B29C 70/52 52/309.13 |
| 2012/0085046 | A1 | * | 4/2012 | Proctor | E04F 13/0826 52/235 |
| 2012/0266562 | A1 | * | 10/2012 | Woolf | E04C 3/07 52/846 |
| 2013/0152498 | A1 | | 6/2013 | Krause | |
| 2013/0232902 | A1 | * | 9/2013 | Mayer | E04B 2/7457 52/483.1 |
| 2017/0198471 | A1 | * | 7/2017 | Krause | E04F 13/0828 |
| 2017/0198481 | A1 | * | 7/2017 | Krause | E04F 13/0817 |
| 2017/0342723 | A1 | * | 11/2017 | Krause | E04F 13/0846 |
| 2017/0356181 | A1 | * | 12/2017 | Krause | E04B 1/40 |
| 2018/0010341 | A1 | * | 1/2018 | Krause | E04B 1/40 |

* cited by examiner

POLYMER-BASED BRACKET SYSTEM FOR EXTERIOR CLADDING

CROSS-REFERENCE TO RELATED APPLICATION

This application is a continuation of U.S. patent application Ser. No. 15/415,068, filed on Jan. 25, 2017, entitled INSULATION SYSTEM FOR BUILDINGS, which is a continuation of U.S. patent application Ser. No. 15/067,966, filed on Mar. 11, 2016, entitled INSULATION SYSTEM FOR BUILDINGS, which is a continuation of PCT International Application Ser. No., PCT/US14/55118, filed on Sep. 11, 2014, entitled INSULATION SYSTEM FOR BUILDINGS, which claims priority from U.S. patent application Ser. No. 14/281,949, filed on May 20, 2014, entitled INSULATION SYSTEM FOR BUILDINGS, which is a continuation-in-part of U.S. patent application Ser. No. 13/763,915, filed on Feb. 11, 2013, entitled POLYMER BASED BRACKET SYSTEM FOR EXTERIOR CLADDING, which is a continuation-in-part of U.S. patent application Ser. No 12/984,051, filed on Jan. 4, 2011, entitled POLYMER-BASED BRACKET SYSTEM FOR METAL PANELS, the entire disclosure of each of which are incorporated herein by reference.

BACKGROUND OF THE DISCLOSURE

In the past, in order to provide a highly thermally efficient (metal) wall or (metal) roof assembly for a building enclosure, it has been necessary for metal materials, typically an exterior and interior metal skin, to be bonded to either side of an insulated panel core inside a factory thereby creating a foam panel. These metal skins are typically profiled and have offsets in them to prevent the exterior metal skin from contacting the interior metal skin. This is done in an effort to prevent metal to metal contact thereby reducing thermal conductivity from the outside of the building. Heat travels in the path of least resistance such that heat can invade a system and affect an interior atmosphere through relatively finite pathways such as fasteners and the like that have metal to metal contact with exterior conditions. Similarly, exterior exposure to cold temperatures can allow for infusion of cold temperatures into a wall construction along highly thermally conductive components. Most applications of metal roof and wall assemblies retain at least some form of metal to metal contact through metal anchors, fasteners, or sill, transition, and window trim. Products of this type are subject to shorter warrantees and life cycles due to the fact that the product is glued or otherwise bonded and is subject to damage and shortened life spans from thermal cycling which causes varying rates of contraction and expansion of the different materials and therefore wears significantly on any given system. Furthermore, these systems often require like materials to be in contact with each other which can lead to reactions such as oxidation which can corrode these materials over time. A metal wall, roof or deck system that creates a thermal break in the heat conductivity path thereby effectively eliminating or greatly reducing thermal bridging from exterior conditions to interior conditions that keeps like materials separate is desired.

SUMMARY OF THE DISCLOSURE

The disclosure is directed One aspect of the present invention includes a building wall construction comprising an exterior building substrate, a layer of insulation disposed within an interior cavity of the wall construction adjacent to the exterior building substrate and a plurality of polymeric brackets coupled to the exterior building substrate. The building wall construction system includes one or more exterior cladding units coupled to the polymeric brackets, wherein the polymeric brackets have a low thermal conductivity, and further wherein the wall construction is free of thermal bridges between the one or more exterior cladding units and the exterior building substrate, such that condensation formed on the wall construction is realized only on the one or more exterior cladding units. In this way, the interior cavity of the wall construction is free from condensation in assembly.

Another aspect of the present invention includes a polymeric bracket system for supporting exterior cladding units on a substrate of a building structure. The polymeric bracket system comprises a plurality of polymeric anchor members, wherein each of the anchor members includes an anchor section and an anchor connection landing. The anchor section is adapted to couple to the substrate of the building structure in assembly. The polymeric bracket system also comprises a plurality of support members, wherein each of the support members includes a support section and a support connection landing, wherein the support section is adapted to couple to an exterior cladding unit. Further, the support connection landing is adapted to couple to the anchor connection landing and a leveling assembly associated with the anchor connection section and the support connection section. The leveling assembly comprises a plurality of apertures disposed on the anchor connection landing of the polymeric anchor members and a plurality of apertures disposed on the support connection landing of the support members. The apertures of the anchor connection landing and the support connection landing are adapted to align with one another in assembly to form sets of aligned apertures. At least one adjustable connecting fastener is adapted to extend through any one of the sets of aligned apertures of the anchor connection landing and the support connection landing. At least one of the apertures of the sets of aligned apertures comprises horizontally disposed oblong apertures for accommodating variations in the substrate of the building structure, such that the polymeric anchor members and the support members can be positioned with respect to one another to accommodate for variations in the substrate of the building structure to provide level exterior cladding units and the plurality of polymeric anchor members adapted to provide a thermal break between the exterior cladding units and the substrate of the building structure.

Yet another aspect of the present invention includes a polymeric bracket system for supporting exterior cladding units on a substrate of a building structure comprising a plurality of polymeric brackets coupled to and spaced apart along the substrate of the building structure. The polymeric brackets have an anchor portion adapted to couple to the substrate of the building structure, and a support portion spaced apart from the anchor portion defining an interior space there between. The polymeric bracket system also comprises a layer of insulating material disposed within the interior space and an elongate support member adapted to couple to the support portions of the plurality of polymeric brackets. Further, the polymeric bracket system comprises one or more exterior cladding units adapted to couple to the elongate support member, wherein the plurality of polymeric brackets provides a thermal break between the exterior cladding unit and the building structure.

Yet another embodiment of the present invention includes a building wall construction comprises an exterior building substrate and a layer of insulation disposed within an interior cavity of the wall construction adjacent to the exterior building substrate. The building wall construction system comprises a plurality of polymeric brackets coupled to the exterior building substrate. Each polymeric bracket includes an anchor section coupled to the building substrate and an attachment landing disposed within the interior cavity of the wall construction. Further, the building wall construction has one or more exterior cladding units coupled to the polymeric brackets at the attachment landing, wherein the polymeric brackets have a low thermal conductivity. The wall construction is free of thermal bridges between the one or more exterior cladding units and the exterior building substrate, such that a thermal break is formed between the exterior cladding units and the building substrate.

Yet another body of the present invention includes a polymeric bracket system for supporting exterior cladding units on a building substrate. The polymeric bracket system comprises an elongate support member adapted to couple to the building substrate. The support member includes a generally planar body portion having a connecting portion extending therefrom. Further, a plurality of polymeric brackets having an anchor section and a support section, wherein the anchor section of each polymeric bracket further comprises a channel. In assembly the connecting portion of the elongate support member is slidably received in the channel of the plurality of polymeric brackets. The support section is spaced apart from the connecting portion defining an interior space there between. The polymeric bracket system further includes a layer of insulating material disposed within the interior space and one or more exterior cladding units adapted to couple to the plurality of polymeric brackets at the support sections thereof. The plurality of polymeric brackets provides a thermal break between the one or more exterior cladding units and the building substrate.

These and other features, advantages, and objects of the present invention will be further understood and appreciated by those skilled in the art by reference to the following specification, claims, and appended drawings.

BRIEF DESCRIPTION OF THE DRAWINGS

The disclosure will now be described with reference to the drawings wherein.

DETAILED DESCRIPTION OF THE DISCLOSURE

Figure 1:
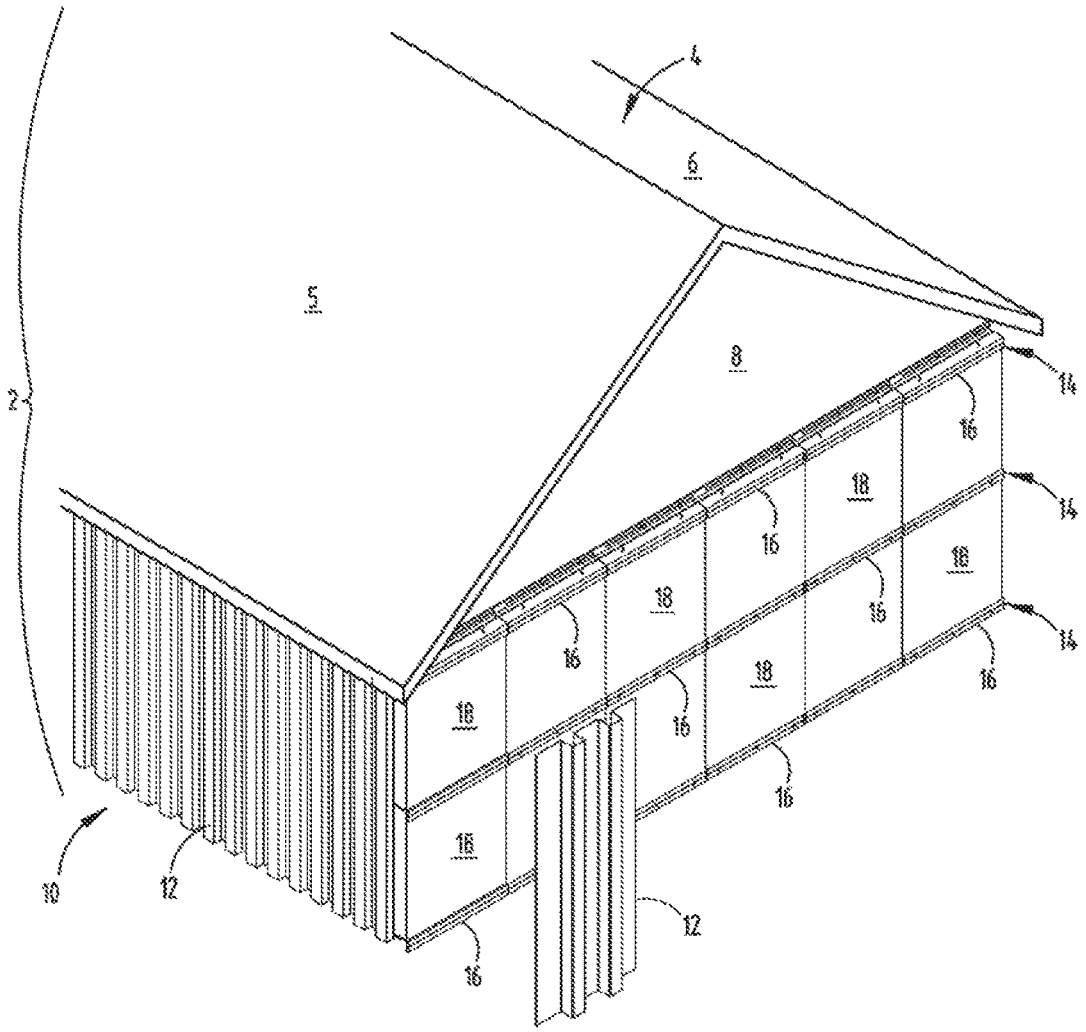
FIG. 1 is a perspective view of a building having an exterior wall construction system.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

For the purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in following specification, are simply exemplary embodiments. Hence, specific dimensions and other physical characteristics relating to the embodiments disclosed herein are not to be construed as limiting, unless expressly stated otherwise.

The reference numeral 2 (FIG. 1) generally designates one embodiment of the present invention wherein a building structure includes a roof 4 with sides 5, 6, a front wall 8, and a side wall 10. The side wall or building substrate 10 is covered by exterior cladding units 12 which, in this embodiment, are depicted as ribbed panels made of a substrate generally known in the industry for use in an exterior surface of a building structure 2 such as steel, aluminum, zinc, and other such substrates. The front wall 8 is shown with a polymeric bracket system having rows 14 made up of polymeric bracket members or girts 16 which exhibit low thermal conductivity and are used to connect the exterior cladding units 12 to the building structure 2. Disposed between rows 14, are channels that are formed between the building substrate 10 and the exterior cladding units 12 when the exterior cladding units 12 are mounted to the bracket members 16. As shown in the embodiment in FIG. 1, insulating material 18 is housed in the channels disposed between the rows 14 of bracket members 16, wherein the insulating material 18, as shown in this embodiment, are modular insulation panels that serve to insulate the building structure 2 in assembly. The insulating material 18 can also be fire retardant panels, sound dampening panels or any other type of insulating material or panel known in the art for providing an interior or exterior wall with a quality for which the panel is known. Other such insulating materials or panels include materials having additives like insecticides, fungicides or colorants for example. Though many types of insulating materials are known in the art, for the purposes of the description below, insulating materials 18, as depicted in the accompanying figures, are exemplified as panels, which may be sealed or unsealed, designed to insulate the building structure. Sealed panels provide a vapor barrier in the wall construction of the present invention. Other insulating materials suitable for use with the present invention include, foam, fiberglass insulation, rigid insulation, semi rigid insulation, blanket insulation, loose fill insulation, spray foam in either fiberglass, rock wool, cellulose based, polystyrene, polyisocyanurate, polyurethane or other polymeric insulation formulations. Further, for the purposes of the description below, the exterior cladding units 12, as depicted in the figures, are exemplified as modular exterior panels made of a metal substrate. The present invention is for use in many different applications such as wall systems, roof systems, decking systems and the like. For purposes of this application, an embodiment of the present invention will be exemplified as a metal wall panel system for description purposes, but is no way designed to limit the scope of the invention to an exterior wall panel system.

Figure 2:
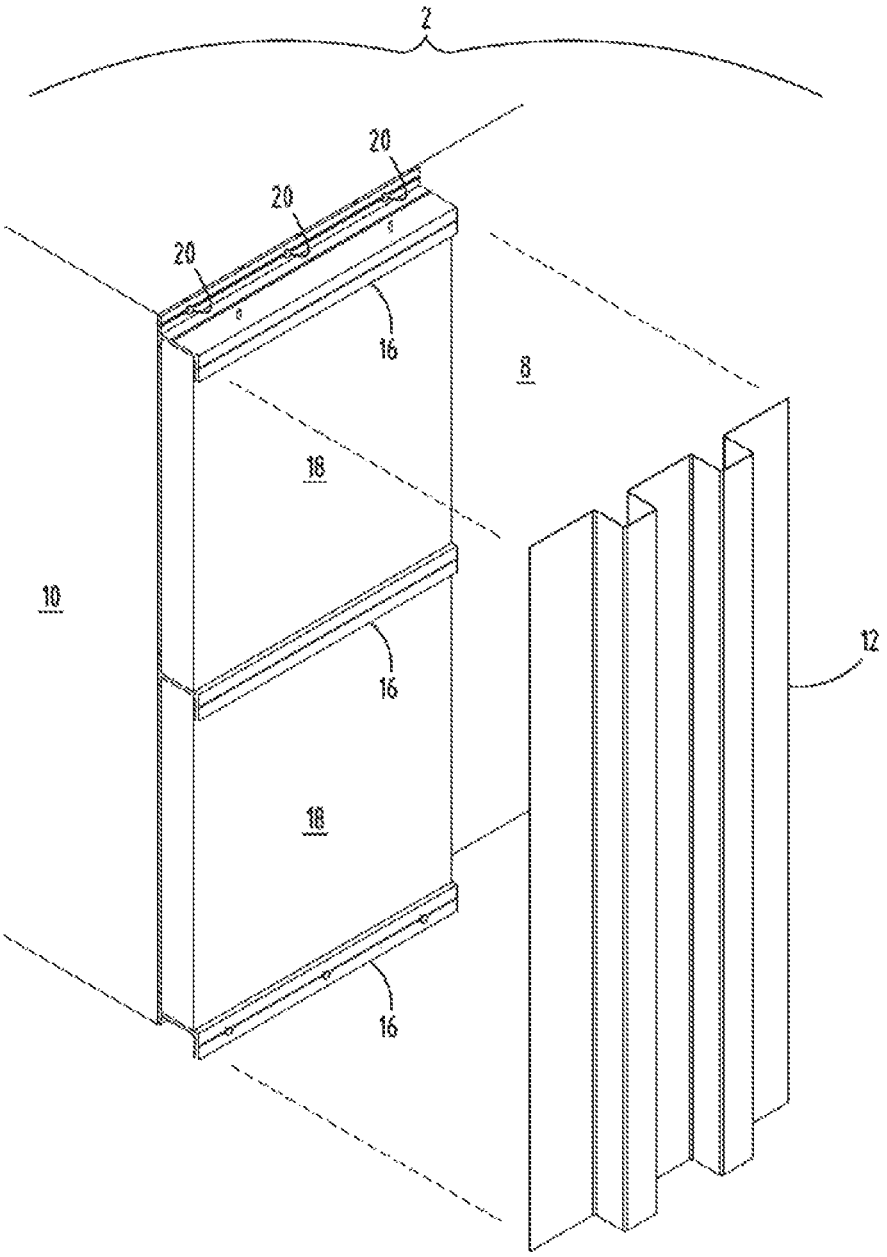
FIG. 2 is a perspective view of a bracket system and exterior cladding unit.
Figure 2A:
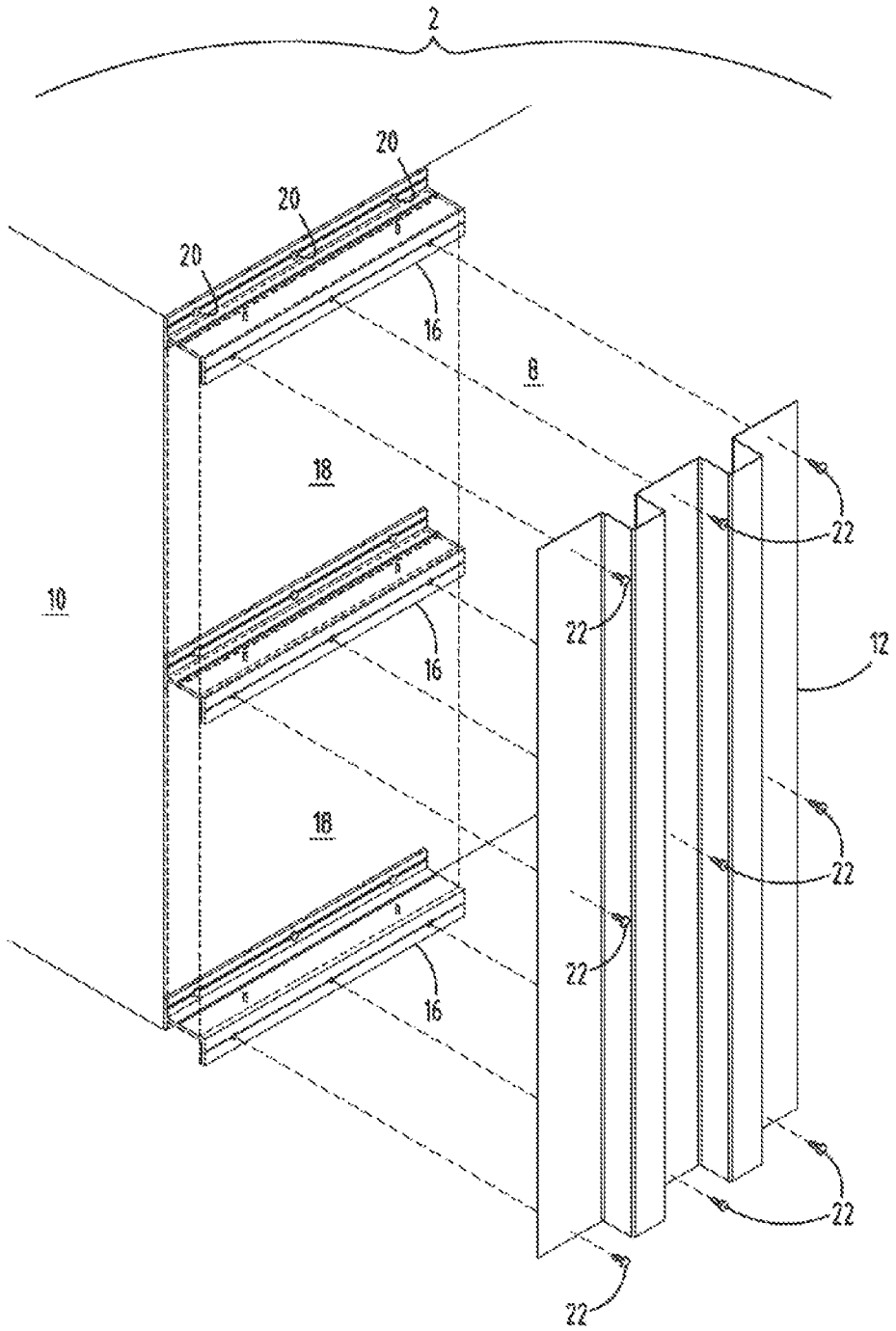
FIG. 2A is a perspective view of a bracket system and exterior cladding unit.

As shown in FIG. 2, fasteners 20, as known in the art, are used to connect bracket members 16 to a building substrate such as the front wall 8 of the building structure 2. As shown in FIG. 2A, fasteners 22 are used to connect the panels 12 to the bracket member 16 as indicated by the dotted lines in assembly thereby rigidly connecting the panels 12 to the substrate or front wall 8 of the building structure 2. As shown in FIG. 2, insulating panels 18 are disposed between the bracket members 16 in the channels formed between rows 14.

Figure 3:
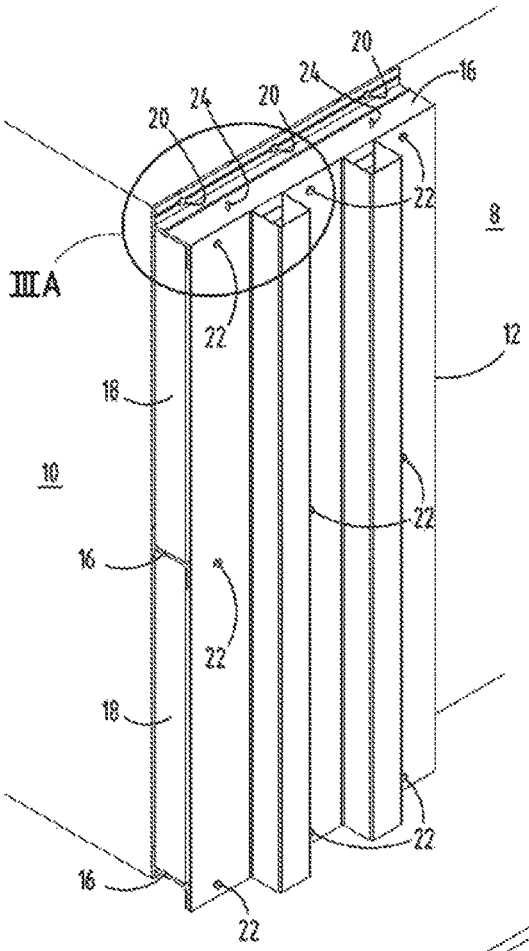
FIG. 3 is a perspective view of a bracket system and exterior cladding unit attached to a building substrate.
Figure 3A:
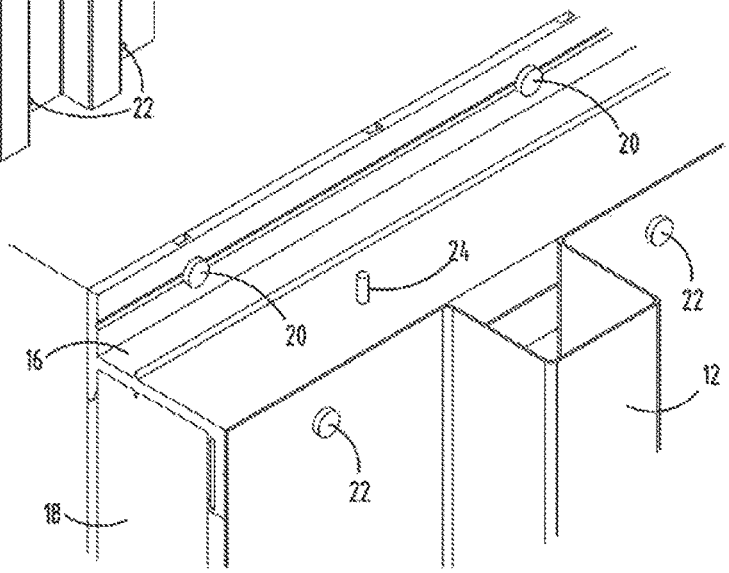
FIG. 3A is a fragmentary perspective view of a bracket system and exterior cladding unit attached to a building substrate.

As shown in FIG. 3, an exterior panel 12 is secured to the bracket member 16 by fasteners 22 and the bracket member 16 are further coupled to the front wall 8 of the building structure 2 by fasteners 20. As shown in FIG. 3A, the bracket members 16 further comprise retention pins 24, or panel retention pins, in this embodiment, which are used to hold insulation panels 18 in place during assembly.

Figure 4:
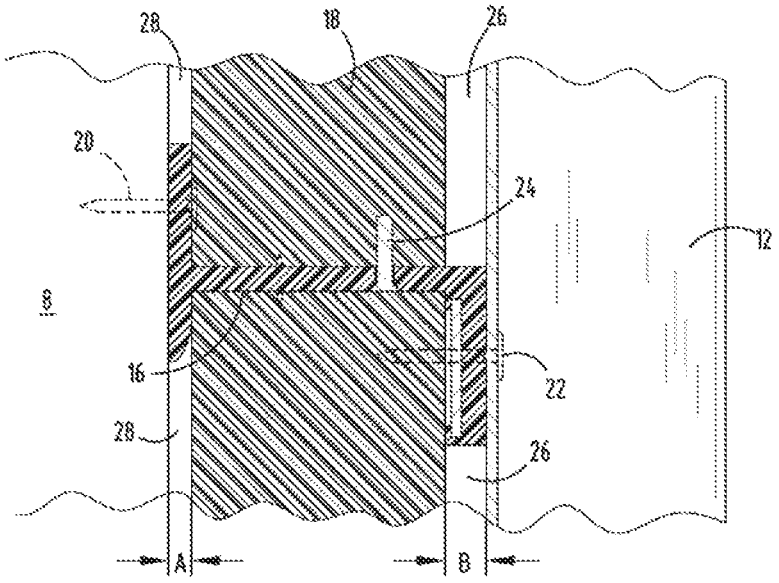
FIG. 4 is a fragmentary side elevational view of a bracket member and exterior cladding unit attached to a substrate.

As shown in FIG. 4, the bracket member 16 is shown operably coupled to a substrate 8 and operably coupled to an exterior panel 12 in a lateral relationship, and has insulation panels 18 vertically disposed on either side of the bracket member 16. In this configuration, the bracket member 16, having low thermal conductivity, creates a thermal break in the path of heat conductivity from the exterior panel 12 to the building substrate 8 in such a way that there is no metal to metal contact. As used herein, the term "thermal break" refers to a break in like materials wherein the material disposed between like materials is comprised of a material having low thermal conductivity such as a polymeric material having a high R-value as further described below. R-values are measurements of the thermal resistance of different materials. R-values are well known by those skilled in the art of the construction and insulation industries. A high R-value indicates a highly insulative material, such as an R-value of R.2 per inch and higher. Conductive materials have a very low R-value, such as steel which exhibits a negligible or nearly non-existent R-value. In the configuration of the present invention, there are no like materials in contact with another, nor is there any metal to metal contact creating a pathway for heat to transfer from the exterior to the interior and vice versa.

As shown in FIG. 4, a ventilation system is comprised in part by vents 26 and 28 disposed above and below the bracket member 16 such that vents 26 are formed between the insulation panel 18 and the exterior panel 12 and vents 28 are formed between the insulation panel 18 and the building substrate 8.

Figure 5:
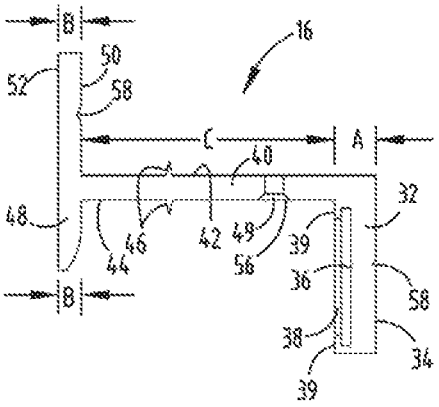
FIG. 5 is a side elevational view of a bracket member.

FIG. 5 generally depicts a side elevational view of a bracket member 16 which, in this embodiment, has a generally Z-shaped configuration with a support section 32, adapted to connect to and support an exterior cladding unit. In this embodiment, the support section 32 of the bracket member 16 includes an exterior surface 34 and interior surface 36 wherein the interior surface 36 further comprises a T-shaped channel 38. The support section 32 has a planar thickness "A" which correlates to the size of the vents 26 which are disposed between the insulation panels 18 and the exterior panels 12, as shown in FIG. 4.

As shown in FIG. 5, the bracket member 16 further comprises a web or body section 40 which has a first side 42 and a second side 44, wherein an aperture 49 is disposed on the body section 40 of the bracket member 16 and is configured to house pins 24 which help to hold the insulation panels 18 in place in assembly. The web or body section 40 connects the support section 32 to the anchor section 48 described below. As shown in FIG. 5, the aperture 49 further comprises a beveled side 56 disposed on the second side 44 of the body section 40 of the bracket member 16. It is also contemplated that the beveled section 56 of aperture 49 can be disposed on the first side 42, the second side 44, or both the first and second sides 42, 44 of the body section 40 of the bracket member 16 for positively capturing a pin 24 (not shown) with a beveled head that corresponds to the counter sunk beveled edge or edges of aperture 49. The body portion 40 further comprises retention fins or panel piercing airlock ribs 46 which, in this embodiment help to hold insulation panels 18 in place. It is further contemplated that the insulation panels 18 (not shown) can be manufactured with a channel that corresponds to the fins or ribs 46 of the bracket member 16 to retain the insulation panels 18 in place in assembly. The body section 40 of the bracket member 16 has a length "C" which generally corresponds to the width of the insulation panels 18. The bracket member 16 further comprises an anchor section 48 having an exterior side 50 and an interior side 52 which is used to anchor the bracket member 16 to a substrate 8 with fasteners 20 such as shown in FIG. 4. The anchor section 48 of the bracket member 16 has a planar thickness "B" which corresponds to the width of the vents 28 as shown in FIG. 4 in a similar fashion as vents 26 correspond to planar thickness "A" of the support section 32.

In the embodiment shown in FIG. 5, the bracket member 16 further comprises channels 58 disposed on both the support section 32 and anchor section 48 which are used to guide fasteners 20 and 22 in assembly. In the embodiment shown in FIG. 5, the support section 32 of the bracket member 16 further comprises a T-shaped channel 38 which is adapted to accept an insert (not shown) which is used to help retain fasteners in assembly as described in more detail below.

Figure 5A:
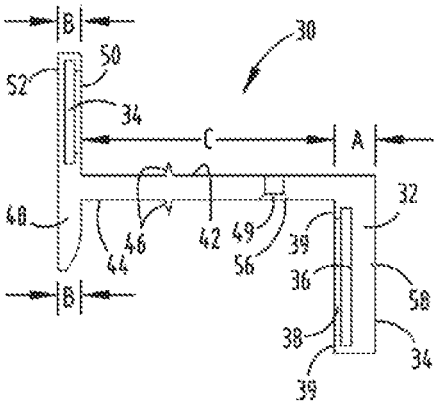
FIG. 5A is a side elevational view of a bracket member.

In the embodiment shown in FIG. 5A, a bracket member 30 generally has similar features as the bracket shown in FIG. 5 with exception of the exterior side 50 of the anchor section 48 having a T-shaped channel 54 for use in accepting an insert (not shown) which is used to help retain fasteners 20 in assembly.

Figure 6:
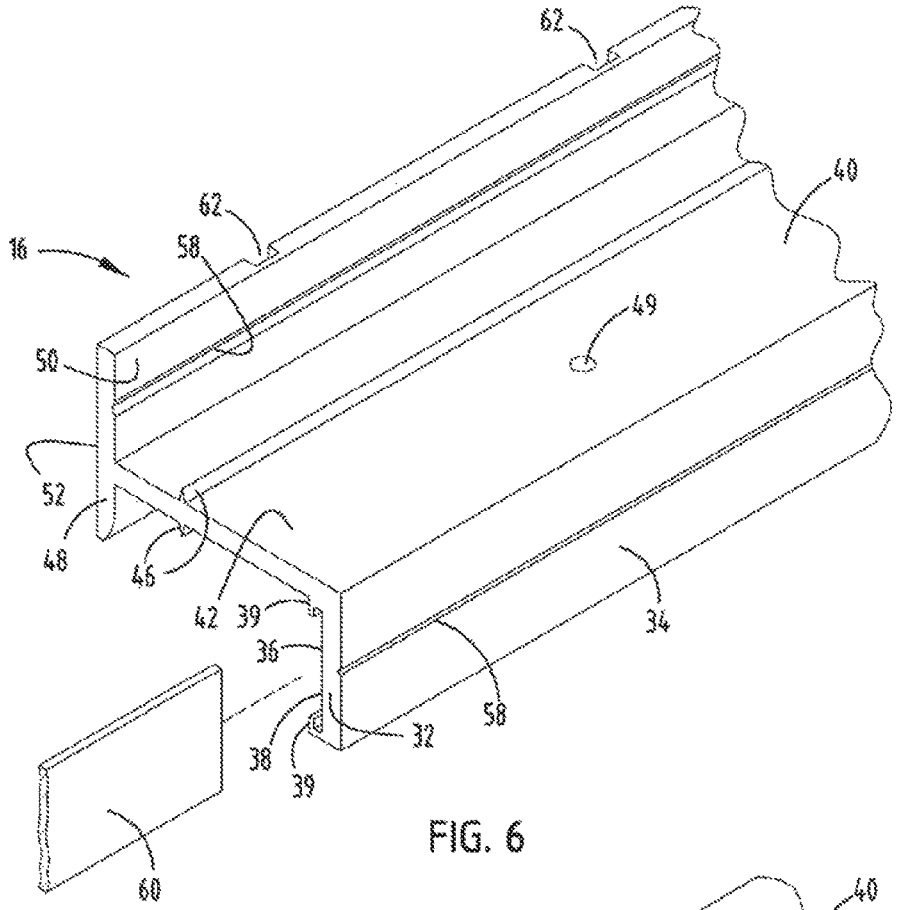
FIG. 6 is a fragmentary perspective view of a bracket member receiving an insert.

As shown in FIG. 6, the bracket member 16 further comprises a slideable, insert 60 which can be inserted into T-shaped channel 38 and moved laterally along T-shaped channel 38 by sliding the insert 60 along the length of the T-shaped channel 38 to facilitate fastener retention when fasteners 22 (not shown) are used to secure exterior panels 12 to the bracket member 16. The insert 60 can be an insert which can be made of a rigid polymer, metal or other like reinforcing material adapted to rigidify the bracket members 16 and retain fasteners in assembly. The insert 60 can also be made from recycled materials such as recycled metal or other like material. The T-shaped channel 38 disposed on the interior surface 36 of support section 32 further comprises channel tabs 39 which positively capture the insert 60 in the T-shaped channel 38 while allowing the insert to slide along the length of the T-shaped channel 38.

Figure 7:
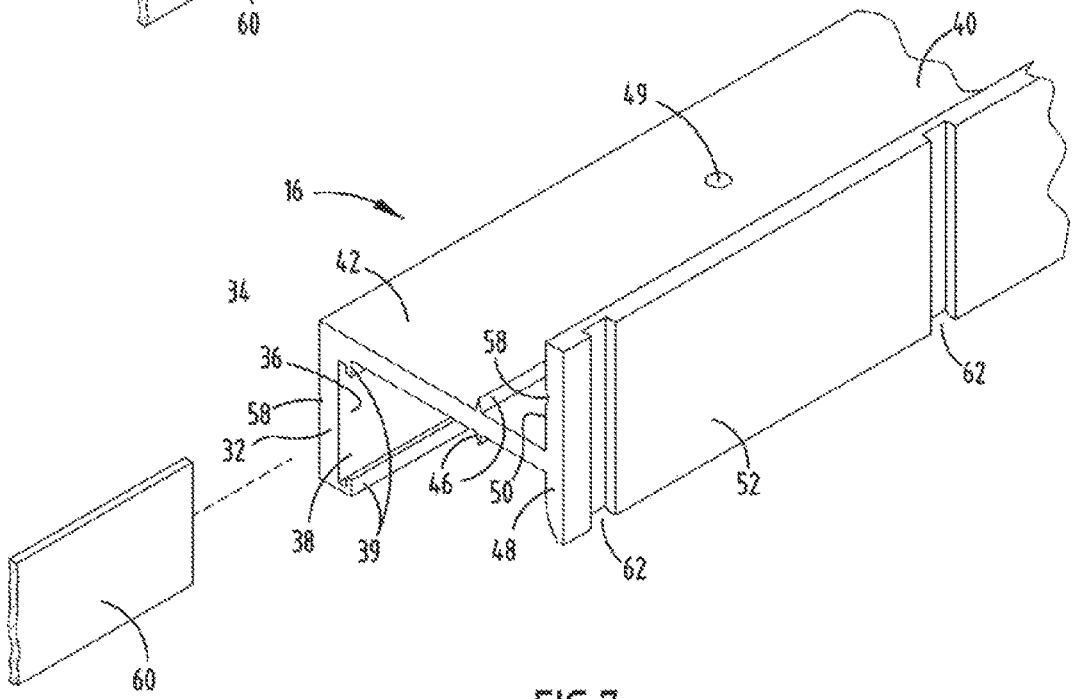
FIG. 7 is a fragmentary perspective view of a bracket member receiving an insert.

In the embodiment shown in FIGS. 6 and 7, the anchor section 48 of the bracket member 16 further comprises channels 62 disposed along the interior side 52 of the anchor section 48 wherein the channels 62 vertically span the length of the interior side 52 of the anchor section 48. The channels 62 make up, in part, the ventilation system of this embodiment by providing a cross ventilation air groove for rear ventilating and rain screening of the bracket and panel system.

The bracket members 16 are developed from an anticorrosive polymeric material that exhibits high insulative qualities or rather, demonstrates high R-value properties such as an R-value in the range of about R.2 to about R8 per inch. Polymeric materials suitable for the present invention include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalamides, polystyrenes, polyphenylsulfones, polyethersulfones, polyfluorocarbons, bioresins and blends thereof. Other such thermoplastics and thermoplastic resins suitable for the present invention are known in the art which demonstrate high R-values and are thereby heat resistant as well as anticorrosive. Thermoplastics of the present invention are also contemplated using a recyclable polymer or are made of a polymeric material which is partially comprised of a renewable resource such as vegetable oil or the like in its composition when an eco-friendly or "green" bracket member is desired. The polymeric material of the present invention can also be reinforced with a reinforcing fiber as detailed below. Bracket members composed of the materials discussed above form a thermal break between exterior panels and building substrates in an effort to control the temperature within a building structure by reducing or eliminating thermal conductivity from the exterior panel to the building substrate and vice versa. In assembly, the R-value of an exterior wall panel system of the present invention can typically exhibit a R-value from about R.2 to about R30 per inch depending on the thickness of the overall system, the insulation materials used and the composition of the bracket members. Further, microspheres, such as polymeric or glass nanospheres, can be added to the makeup of the brackets to provide further insulative properties and increased R-value expression.

There are several different types of measurements that relate to a materials ability to insulate, resist, transmit or conduct heat across a material. Particularly, a material's K-value relates to a specific material's thermal conductivity, a material's C-value correlates to the material's thermal conductance, a material's R-value relates to a material's thermal resistance, and a U-value relates to the thermal transmittance of an overall system. In designing a wall, roof or deck bracket and panel system providing adequate insulative properties for a building structure, materials with low K-values and C-values are desired while materials with high R-values are desired. When this set of conditions is met, the overall thermal transmittance, or U-value, of the system is low. Thus, the lower the U-value, the lower the rate heat thermally bridges from one material to another. A building structure having a well insulated system will have a much lower U-value than an uninsulated or poorly insulated system exhibiting high thermal transmittance.

Regarding the R-value of the bracket members of the present invention, a relatively high R-value is desired to ensure adequate insulation of a building structure from outside elements by making a bracket that creates a thermal break in a wall panel system. A range of R-values for the polymeric materials used to construct the bracket members described above would be a range of about R.2 to about R8 per inch in order to create a thermal break that effectively reduces or eliminates thermal bridging. The thermal conductivity, or K-value, is the reciprocal of the material's R-value, such that for a polymeric material exhibiting an R-value of about R.2 to R8 per inch, the correlating K-value for that material would be from about K5 to about K0.125 per inch. Thus, in comparison to present day metal brackets used in other bracket and panel systems made of iron or steel, a polymeric bracket member of the present invention will exhibit a K-value of approximately about K.5 to about K0.125 per inch at a given set of conditions as compared to a bracket made from a metallic material such as iron or steel which would have an approximate K-value as high as K32 to K60 per inch at the same conditions. This is because metallic materials, such as iron and steel, have low or negligible R-values and are well known conductors of heat. Steel is known to have an R-value of about 0.003R per inch. Thus, for example, a steel bracket compared to a polymeric bracket of the present invention having an R-value of R.55 would be 183 times more thermally conductive.

The bracket members of the present invention are typically molded members which are formed from the materials noted above and generally used in molding processes such as injection molding, extrusion molding, pultrusion molding and other such molding techniques known in the art. In order to provide a polymeric bracket having comparable strength to the metal brackets known in the art, a reinforcing fiber may be introduced into the polymeric mix to increase the strength of the polymeric bracket member. For example, glass fibers (fiberglass), carbon fibers, cellulose fibers, nylon fibers, aramid fibers, and other such reinforcing fibers can be introduced into the overall polymeric composition before or during the molding process, thereby resulting in a bracket member which has a sufficiently high R-value to create a thermal break in a metal wall system of a building structure, while also having the requisite strength to adequately support exterior panels of a metal panel wall system on a building substrate.

In building construction, condensation is a very undesirable phenomenon as condensation in building construction can cause dampness, rotting, corrosion, mold and energy loss due to increase heat transfer. Condensation which occurs within a substructure, such as an exterior cladding system, can be caused by thermal bridges which exist within the substructure. As noted above, the present invention creates a thermal break between the external environment and a building substrate. As such, the present invention helps to reduce condensation or eliminates condensation all together within in the wall construction. Condensation occurs on hard surfaces during the formation of dew. For example, water condensing on a glass of ice water or on the inside of a window, is the result of the glass surfaces cooling to a temperature below the dew point of the air which is in contact with the glass surfaces. The present invention serves to move the dew point to the outside of a building substrate by eliminating all thermal linear point bridges to the interior cavity of the wall system, and thereby moving the dew point entirely from the interior of the wall construction to the exterior of the wall construction. Thus, with reference to FIG. 3, the exterior cladding unit 12 does not allow for thermal bridging to occur between the external environment which is in contact with the external cladding unit 12, to the building substrate 8. The space in between the building substrate 8 provides an interior cavity in which insulating members 18 are disposed. As noted above, the polymeric brackets 16 have a low thermal conductivity and therefore create a wall construction which is free of thermal bridges between the exterior cladding unit 12 and the building substrate 8, such that cold points do not develop from a cold outside exposure which can lead to condensation formation. Thus, condensation will be formed only on the exterior of the wall construction, or exterior cladding unit 12, such that the interior cavity, having the insulating members 18 disposed therein, is free from condensation.

Figure 8:
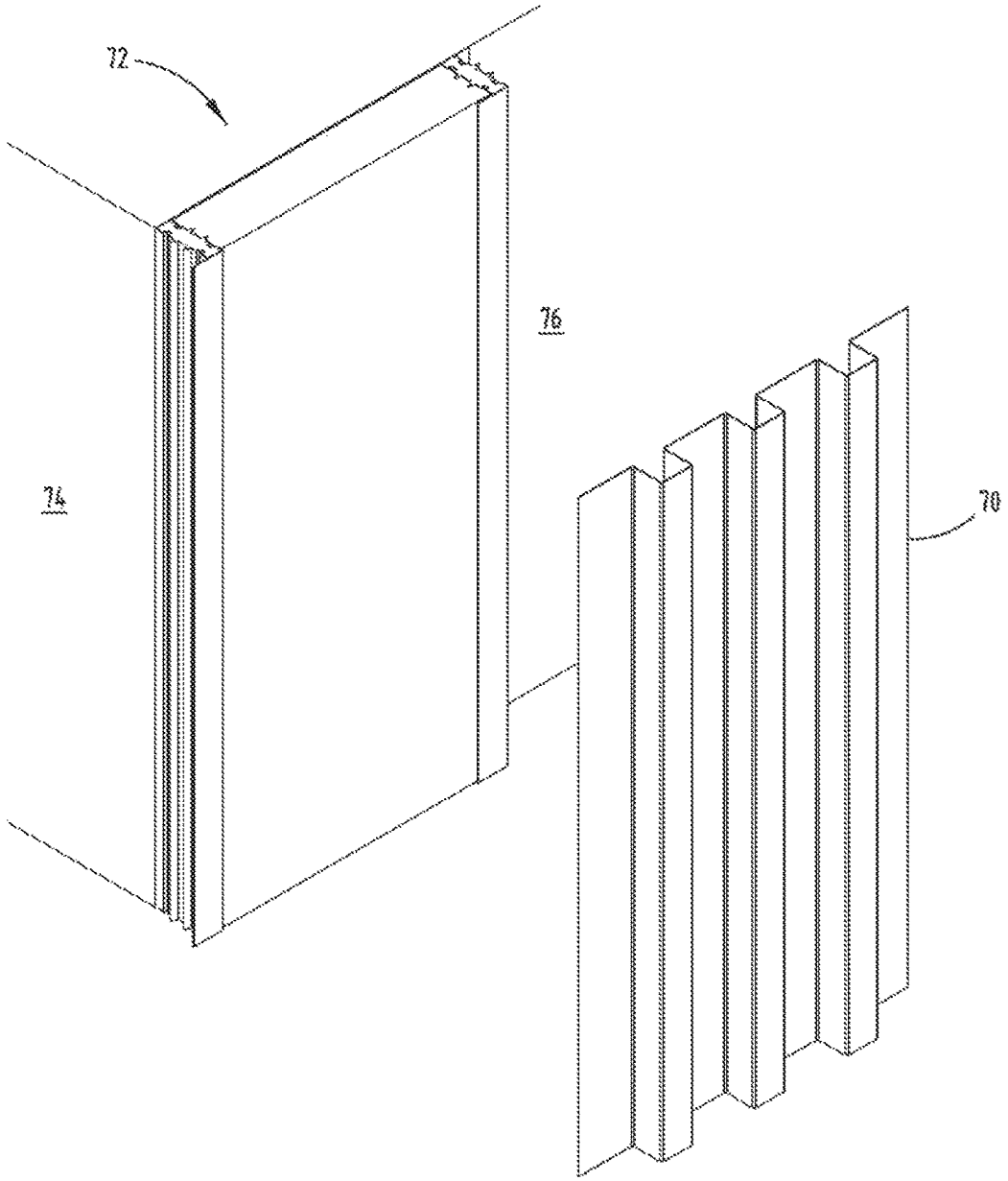
FIG. 8 is a perspective view of another bracket system and exterior cladding unit.
Figure 8A:
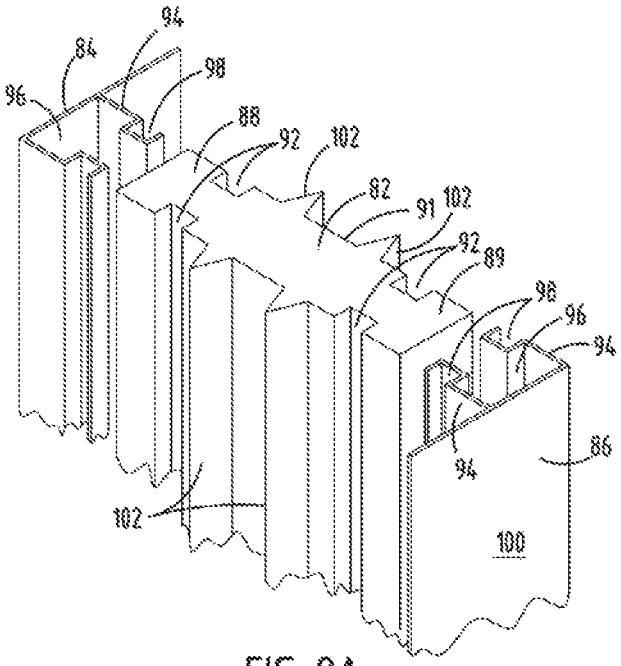
FIG. 8A is an exploded fragmentary perspective view of a bracket system.
Figure 9:
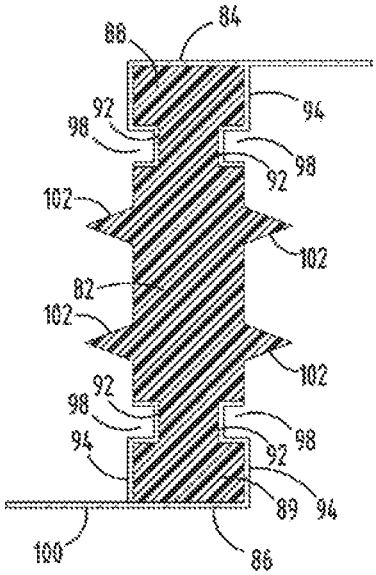
FIG. 9 is a side elevational view of a bracket system.
Figure 10:
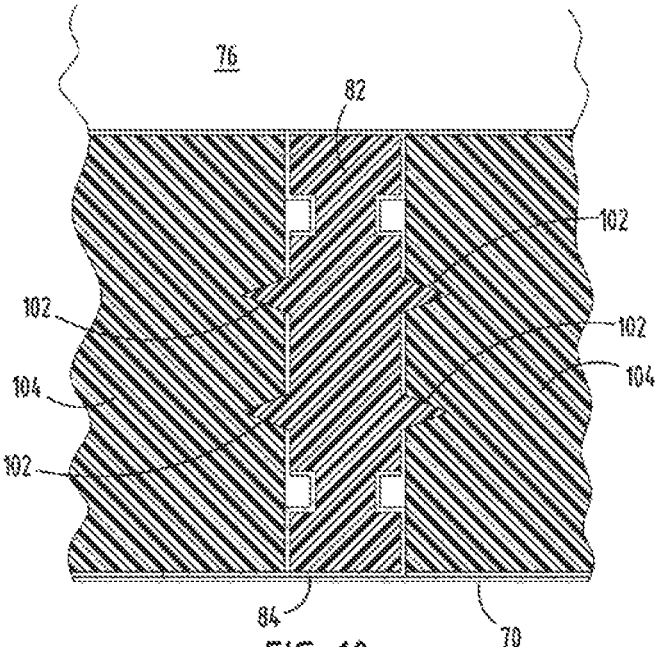
FIG. 10 is a fragmentary side elevational view of a bracket system attached to a building substrate and exterior panel.
Figure 11:
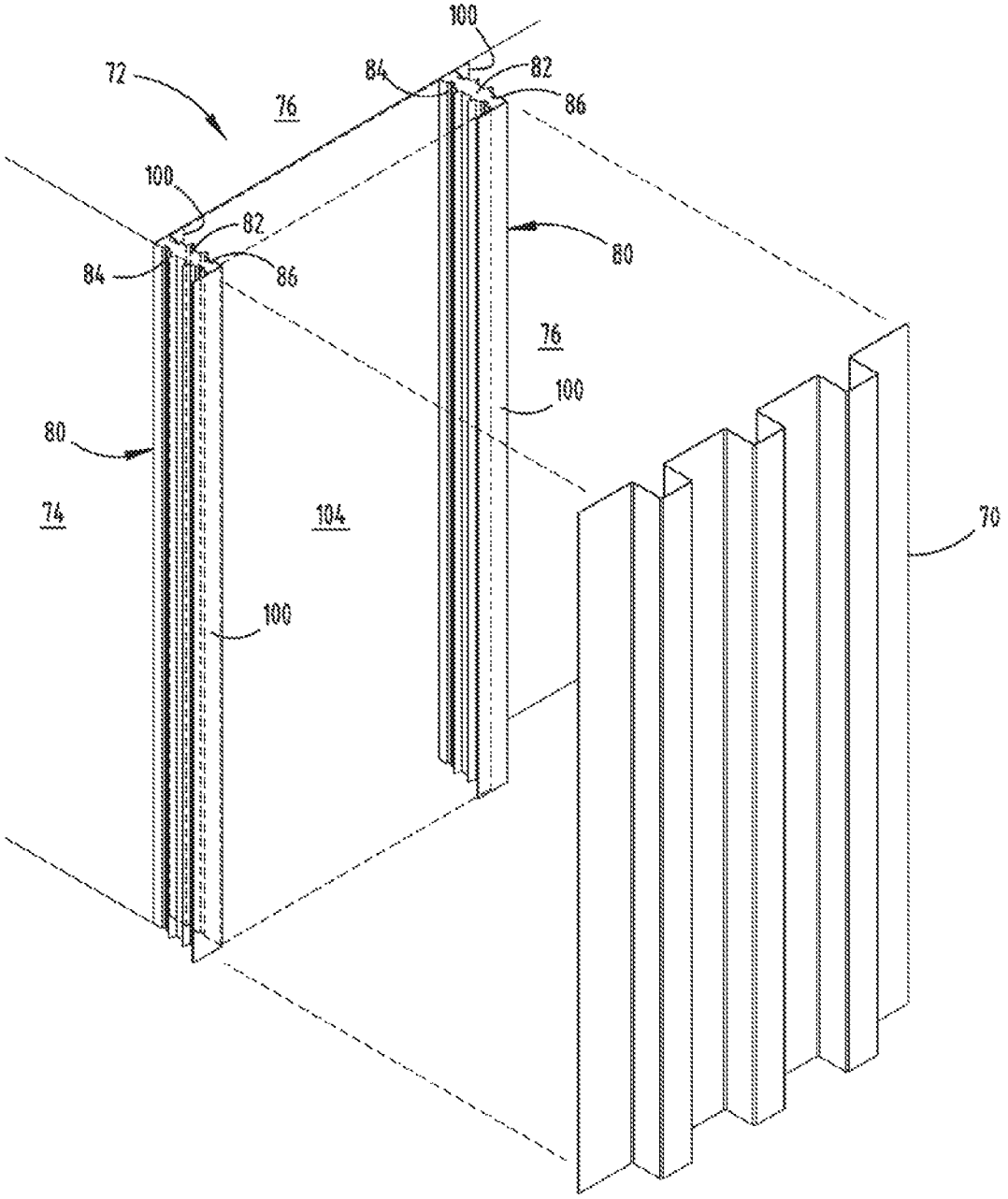
FIG. 11 is an exploded perspective view of a bracket system and exterior panel.

In the embodiment shown in FIG. 8, dotted lines indicate the mounting of an exterior cladding unit 70, shown in FIG. 8 as an exterior panel, to a building structure 72. The building structure has walls 74, 76 which can be any substrate normally found on a building structure such as a sheathed stud wall, a concrete wall, a masonry wall, or a steel roof deck. The exterior panel 70 attaches to the building structure via a bracketing system 80 (FIG. 8A) which comprises a grooved stud 82 generally made of a polymeric material having a significantly high R-value (as described above for bracket member 16) and clips 84, 86 which are generally made of a metallic material. As shown in FIG. 8A, the stud 82 has a first end 88 and a second end 89 which further comprise channels 92 giving the first end 88 and second end 89 a general T-shaped configuration. Channels 92 are U-shaped channels disposed on first and second sides 90 and 91 of the grooved stud 82. Clips 84 and 86 comprise flanges 94 which coordinate to form a T-shaped channel 96 which generally correlates to the T-shaped first and second ends 88 and 89 of the stud 82. The clips 84 and 86 further comprise U-shaped channels 98 which correlate with U-shaped channels 92 of the grooved stud 82. Thus, the configuration of the stud 82 and the clips 84 and 86 coincide such that the clips 86 and 84 can slide on to the ends 88 and 89 of the stud 82 as shown in FIG. 9. The clips 84 and 86 further comprise attachment surfaces 100 which are used to attach the clips to either a building substrate or an exterior panel. The stud 82 further comprises retention fins, or in this embodiment, panel retention fins 102 used to keep insulating materials, such as panels 104, in place in assembly as shown in FIG. 10. The panel retention fins 102 are disposed on both first and second sides 90, 91 of the stud 82. As shown in FIG. 11, a plurality of bracketing systems 80 are attached to a building structure 72 on the building structures exterior walls 74 or 76. The bracketing systems 80 are attached to the wall 76 as shown in FIG. 11, in a vertical stud-like fashion. In this fashion, clip 84 is attached to the building structure substrate or wall 76 at the attachment surface 100 of the clip 84. The stud 82 is then disposed between clip 84 and clip 86 and the clips are attached to stud 82 in the manner shown in FIG. 9 such that attachment surface 100 of clip 86 is exposed for the attaching of an exterior panel 70.

Figure 12:
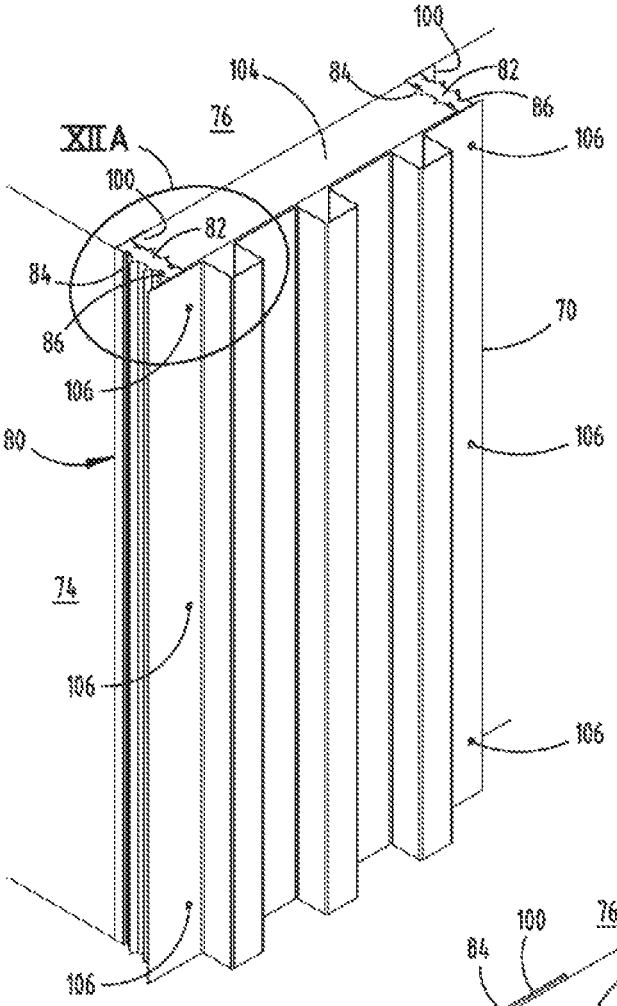
FIG. 12 is a perspective view of a bracket system attached to a building substrate and exterior panel.

As shown in FIG. 12, the exterior panel 70 is attached to a plurality of bracketing systems 80 by fasteners 106. Between bracketing systems 80, a panel 104 is disposed wherein the panel 104 is made of a material similar to the panels 12 as described above. In this configuration, the stud 82 creates a thermal break between the exterior panel 70 and the building substrate 76. Further, in this configuration, there are no like materials in contact with another, nor is there any metal to metal contact creating a pathway for heat to transfer from the exterior to the interior and vice versa.

Figure 12A:
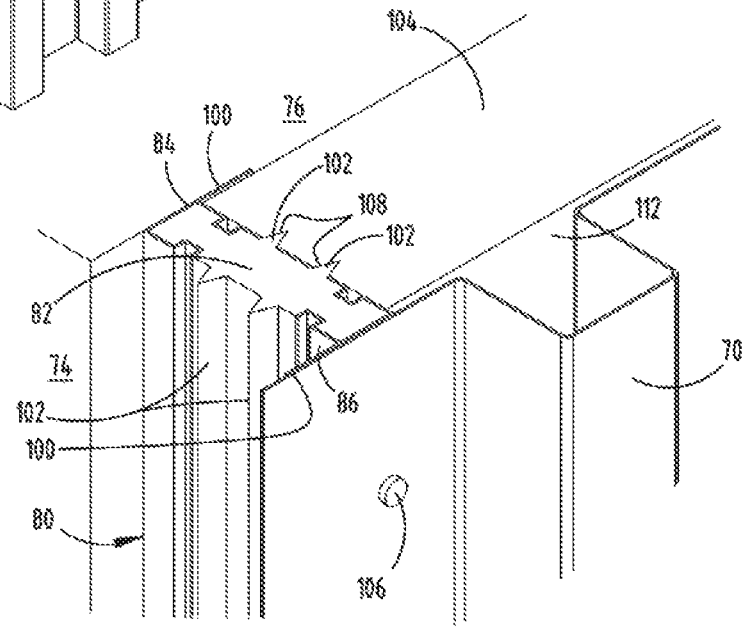
FIG. 12A is a fragmentary perspective view of a bracket system attached to a building substrate and exterior panel taken at location XIIA of FIG. 12.

As shown in FIG. 12A, a bracketing system 80 is shown attached to a substrate 76 via a clip 84 through fasteners (not shown) and further attached to an exterior panel 70 via clip 86 using fasteners 106. The panel retention fins 102 are shown fitting into grooved channels 108 formed in the panel 104 to help align the panel 104 in assembly. A ventilation system includes vents 110 and 112, which correlate to the thickness of attachment surfaces 100 of clips 84 and 86, wherein the vent 110 is disposed between panel 104 and the substrate 76 and vent 112 is disposed between panel 104 and exterior panel 70.

Figure 13:
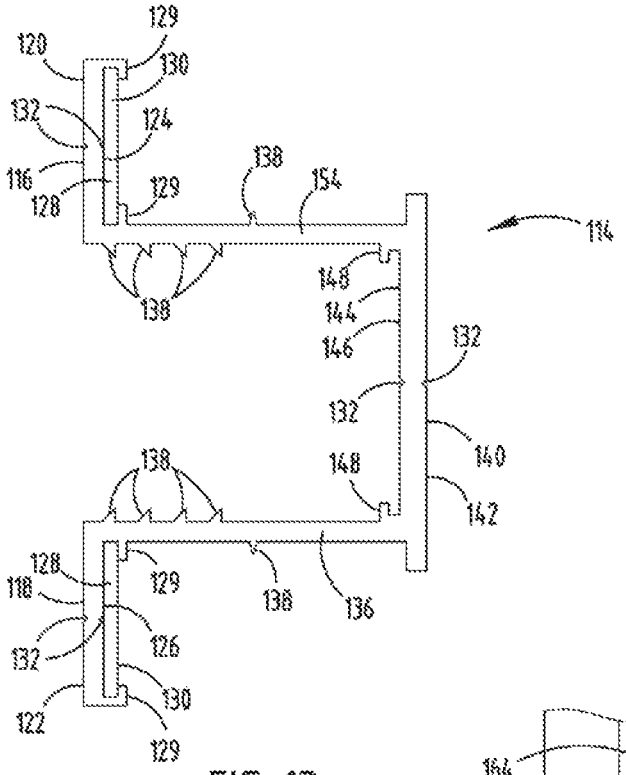
FIG. 13 is a side elevational view of a bracket system of another embodiment of the present invention.

In another embodiment of the present invention, a polymeric bracket member 114 is shown as a hat-shaped bracket member, or girt (FIG. 13). In this embodiment, the bracket member 114 comprises first and second bottom anchor flanges or sections 116 and 118 having exterior sides 120 and 122 respectively, and interior sides 124 and 126 respectively. T-shaped channels 128 are disposed on the interior sides 124, 126 of anchor flanges 116, 118, and the T-shaped channels 128 have channel tabs 129 which are used to positively capture an insert 130 in assembly. Fastener guide channels 132 are disposed on the exterior and interior sides 120, 122, 124, 126 of the bottom anchor flanges 116, 118 for use in guiding fasteners through a bracket member into a substrate. The bracket member 114 further comprises first and second webs or side walls 134, 136 which have insulation panel retention fins 138 disposed on either side of side walls 134, 136 to facilitate the retention of insulation panels in assembly. The bracket member 114 further comprises a top support section 140 which has an exterior side 142 and an interior side 144. Both the exterior side and the interior side have fastener guide channels 132 and the interior side 144 further comprises a T-shaped channel 146 having tabs 148 for positively capturing a variable gauge insert (not shown) in assembly.

Figure 13A:
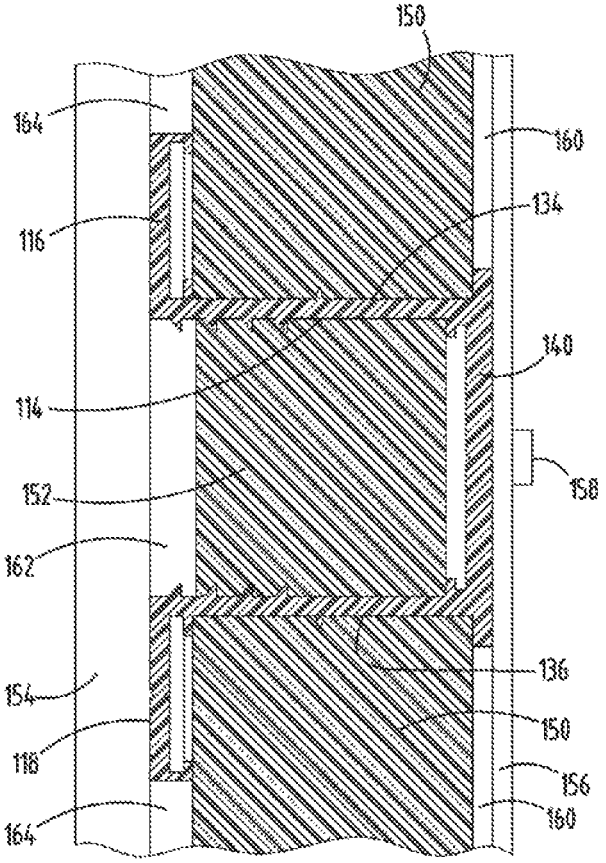
FIG. 13A is a fragmentary side elevational view of a bracket system attached to a substrate and exterior panel.

As shown in FIG. 13A, bracket member 114 is shown in a wall assembly wherein the bracket member 114 is attached to a building substrate 154 at bottom anchor flanges 116, 118. This attachment is made by fasteners known in the art (not shown). Panels 150 and 152 are shown in the assembly wherein panels 150 span between bracket member 114 and another like bracket member 114 (not shown). Panel 152 is disposed in a channel formed between side walls 134 and 136 of bracket member 114. An exterior panel 156 is attached to top support section 140 of bracket member 114 via fasteners 158. A ventilation system further includes vents 160, which are formed between panels 150 and exterior panels 156, for ventilation and rain sheeting of the system. Vents 164 are formed between the panels 150 and the building substrate 154 for cross-ventilation and moisture sheeting purposes and vent 162 is formed between panel 152 and the building substrate 154 for ventilation within the interior space of bracket member 114. In this configuration, bracket member 114, formed from a polymeric material having a high R-value, forms a thermal break between the exterior panel 156 and the building substrate 154. Further, in this configuration, there are no like materials in contact with another, nor is there any metal to metal contact creating a pathway for heat to transfer from the exterior to the interior and vice versa.

Figure 14:
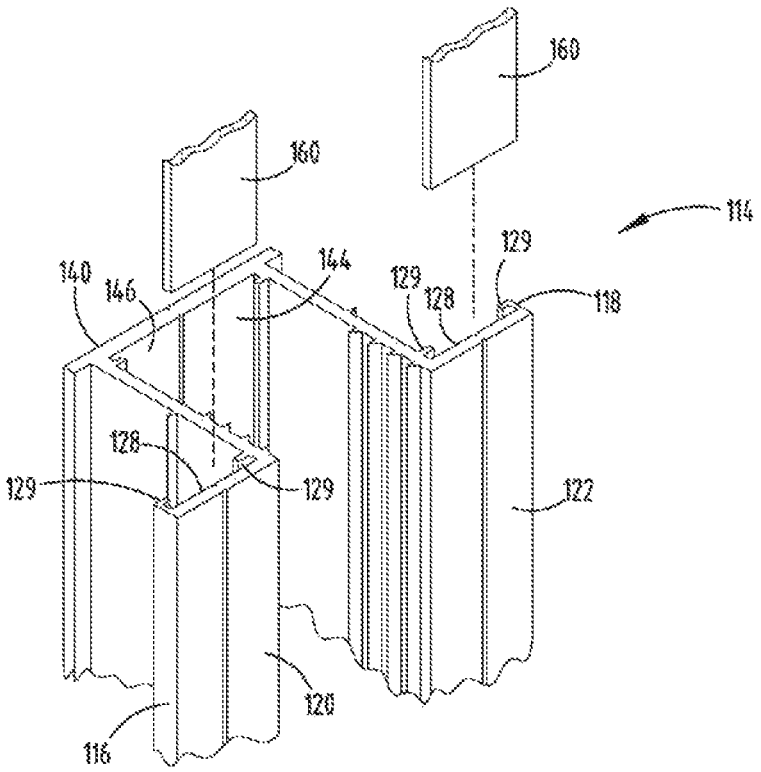
FIG. 14 is a fragmentary perspective view of a bracket member receiving inserts.
Figure 15:
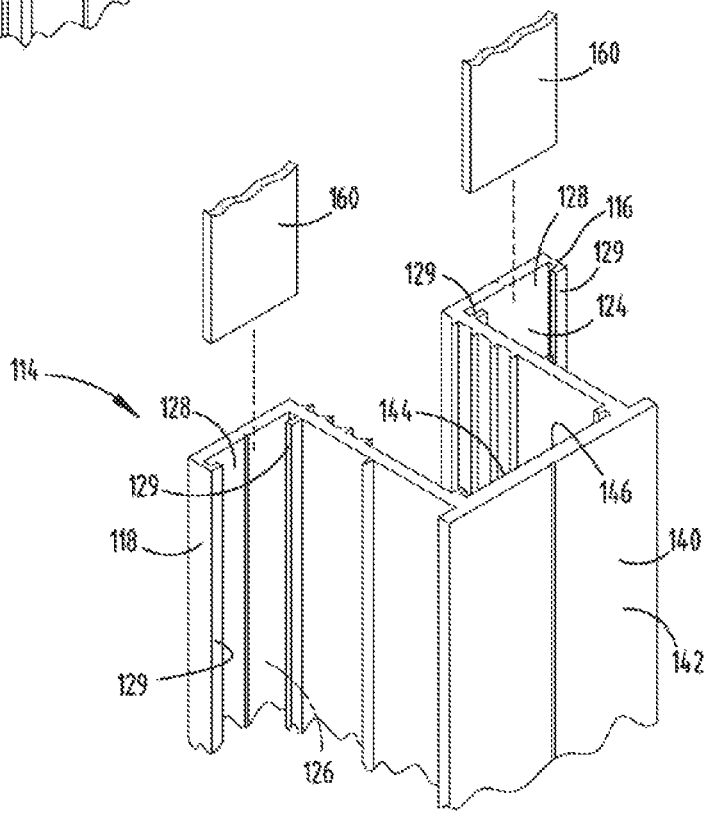
FIG. 15 is a fragmentary perspective view of a bracket member receiving inserts.

As shown in FIGS. 14 and 15, the bracket member 114 is shown with inserts 160 to be inserted in the T-shaped channels 128 disposed on the interior sides 124, 126 of the bottom anchor flanges 116, 118 where they will be held in place by channel tabs 129. The inserts 160 are made of a rigid material, such as a rigid polymer or metallic material and are slideable along the length of the T-shaped channels 128. Further, it is contemplated that a similar insert (not shown) can be inserted in the T-shaped channel 146 disposed on the interior side 144 of the top support 140 of bracket member 114. As with the bottom anchor flanges 116, 118, the top support 140 has channel tabs 148 disposed on the interior side 146 of the top support 140, which hold an insert (not shown) in place in assembly. An insert used in the T-shaped channel 146 is slidable along the length of the channel 146 to a desired location where fasteners (not shown) will be used to hold an exterior panel (not shown) in place on top support 140. The inserts 160, as well as the insert used in T-shaped channel 146, are used to retain the fasteners in place in assembly.

Figure 16:
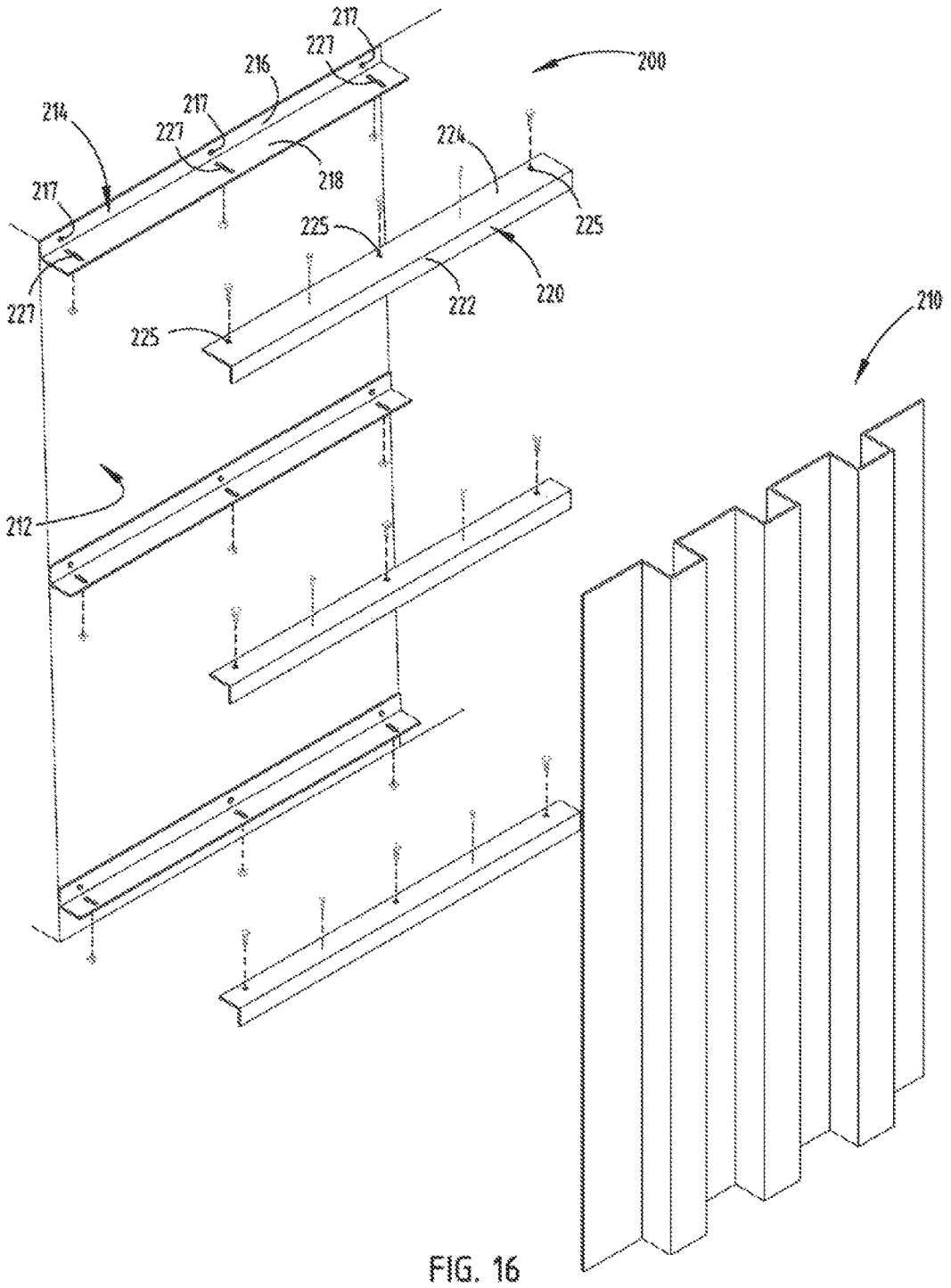
FIG. 16 is an exploded perspective view of an adjustable bracket system.

Referring to FIG. 16, a bracket system 200 is generally shown for supporting an exterior cladding unit 210 to a substrate 212 of a building structure. In the embodiment shown in FIG. 16, the substrate of the building structure 212 is depicted as a wall substrate, however, it is contemplated that the building substrate can be a roof, a deck, a landing, or any other surface disposed on a building structure. As shown in FIG. 16, the exterior cladding unit 210 is a grooved exterior cladding unit similar to exterior cladding unit 12 shown in FIG. 1. The bracket system 200, as shown in FIG. 16, comprises, in this embodiment, a two-part bracket structure made up of multiple anchor members 214 and multiple support members 220. Each anchor member comprises a generally L-shaped configuration having a vertical wall 216 and a horizontal connection landing section 218. The vertical wall 216 forms an anchor section which is adapted to couple to the substrate 212 of a building structure via apertures 217. Thus, the anchor section 216 provides a vertical contact surface for attaching the anchor member 214 to the substrate 212 of the building structure.

Figure 17:
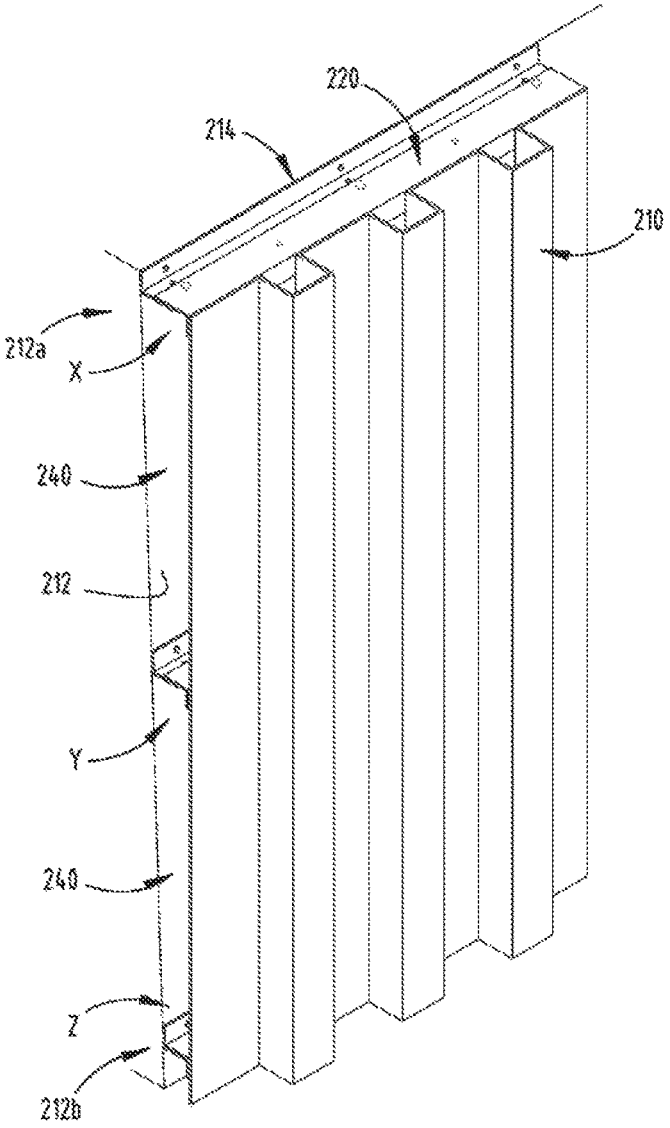
FIG. 17 is a perspective view of an exterior cladding unit attached to a substrate using the bracket system of FIG. 16.
Figure 18:
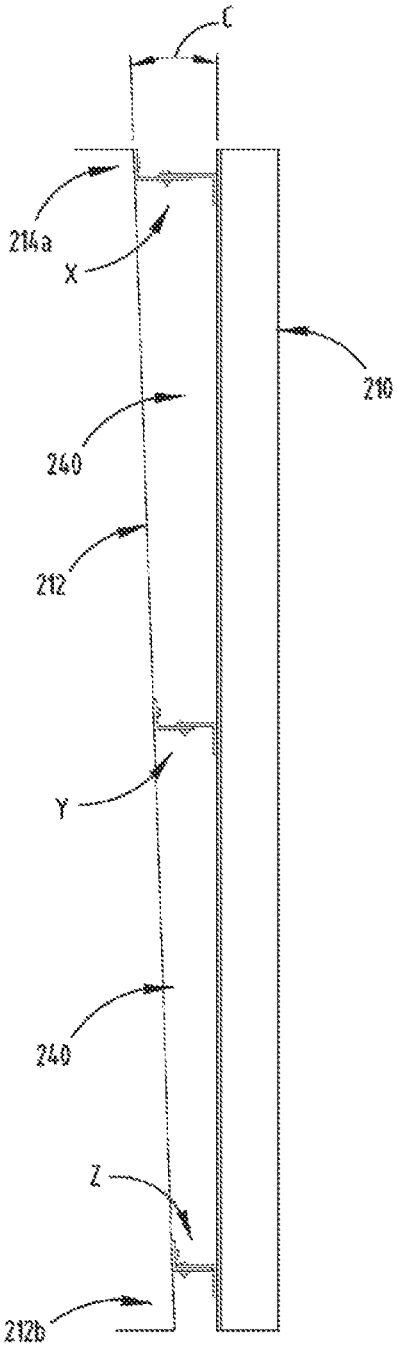
FIG. 18 is a side elevational view of the embodiment shown in FIG. 17.

Each support member 220 comprises a generally L-shaped configuration having a vertical support section 222 and a horizontal connection landing section 224. In assembly, the vertical support section 222 is adapted to couple to the exterior cladding unit 210, as shown in FIG. 17. The horizontal connection section 224 of the support member 220 provides a support connection landing adapted to couple to the anchor connection landing 218 of the anchor member 214. The bracket system 200 shown in FIG. 16 is an adjustable bracket system which provides for a slidable connection between anchor member 214 and support member 220. This adjustable connection is made possible by apertures 225 disposed on the support connection landing 224 of the support member 220 being aligned with apertures 227 disposed on the anchor connection landing 218 of the anchor member 214. The connection between anchor member 214 and support member 220 is slidably adjustable by the oblong shape of the apertures 227 disposed on the anchor connection landing 218. While the apertures 227 of the anchor connection landing 218 are horizontally disposed oblong apertures, it is contemplated that apertures 225, which appear as fixed round-shaped apertures in FIG. 16 disposed on the support connection landing 224 of the support member 220, can also be horizontally disposed oblong-shaped apertures. Thus, the bracket system 200 is designed to have the connection landing of either the anchor member 214 or the support member 220 having oblong-shaped apertures that align with fixed apertures disposed on the other member to provide a slidably adjustable relationship between the anchor member 214 and the support member 220 which is slidably adjustable along the length of the oblong-shaped apertures 227 in FIG. 16, such that the bracket system 200 can accommodate for variations in the substrate 212 of the building structure to provide a plumb and level exterior surface made up of exterior cladding units 210. As better shown in FIGS. 17 and 18, the substrate 212 of the building structure is not perfectly level or plumb, such that the bracket system 200 can be used to connect an exterior cladding unit 210 in a manner that is level due to the slidable adjustment features of the anchor members 214 with respect to the support members 220. Specifically, as shown in FIGS. 17 and 18, three sets of anchor members and support members 214, 220 are indicated as sets X, Y, and Z. The building substrate 212 is an inclined substrate which extends outwardly from the top portion 212*a* of the substrate 212 to a bottom portion 212*b* of the substrate 212. Thus, in order to provide a level and plumb exterior cladding unit 210, the anchor member and support member 214, 220 making up set X are extended to a larger degree as compared to sets Y and Z. As shown in FIGS. 17 and 18, set X appears to have the maximum extension possible as dictated by the length of the oblong apertures 227 disposed on the connection landing 218 of the anchor section 214, while set Z appears to have the support member 220 disposed in a close relationship with anchor member 214 to provide a minimal degree of extension. As further shown in FIG. 18, set Y is set at an extension level somewhere between that of set X and set Z. Thus, the exterior cladding unit 210, shown in FIGS. 17 and 18, appears plumb and level while the building substrate 212 is inclined. In this way, the present invention provides a bracket system 200 adapted to retrofit a building structure having variations disposed thereon such that the bracket system 200 of the present invention can accommodate for these variations to provide a plumb and level exterior surface.

The bracket system 200 of the present invention is further contemplated to provide a thermal break from the exterior cladding unit 210 to the substrate 212 of a building structure. The thermal break of bracket system 200 operates in much the same way as the thermal break described in relation to the polymeric bracket system described in FIGS. 1-7. While the bracket structure 16 described in FIGS. 1-7 is made of a polymeric material as noted above, it is contemplated that the bracket support system 200 of the present invention needs only one of either the anchor member 214 and support member 220 to be made up of a polymeric material in order to provide a sufficient thermal break between the exterior cladding unit 210 and the substrate 212 of the building structure. Thus, either the anchor member 214 or the support member 220 can be made of a heat-conducting material, so long as the reciprocal member is comprised of a polymeric material capable of providing a thermal break from the exterior cladding unit 210 to the substrate 212 of a building structure.

Figure 19:
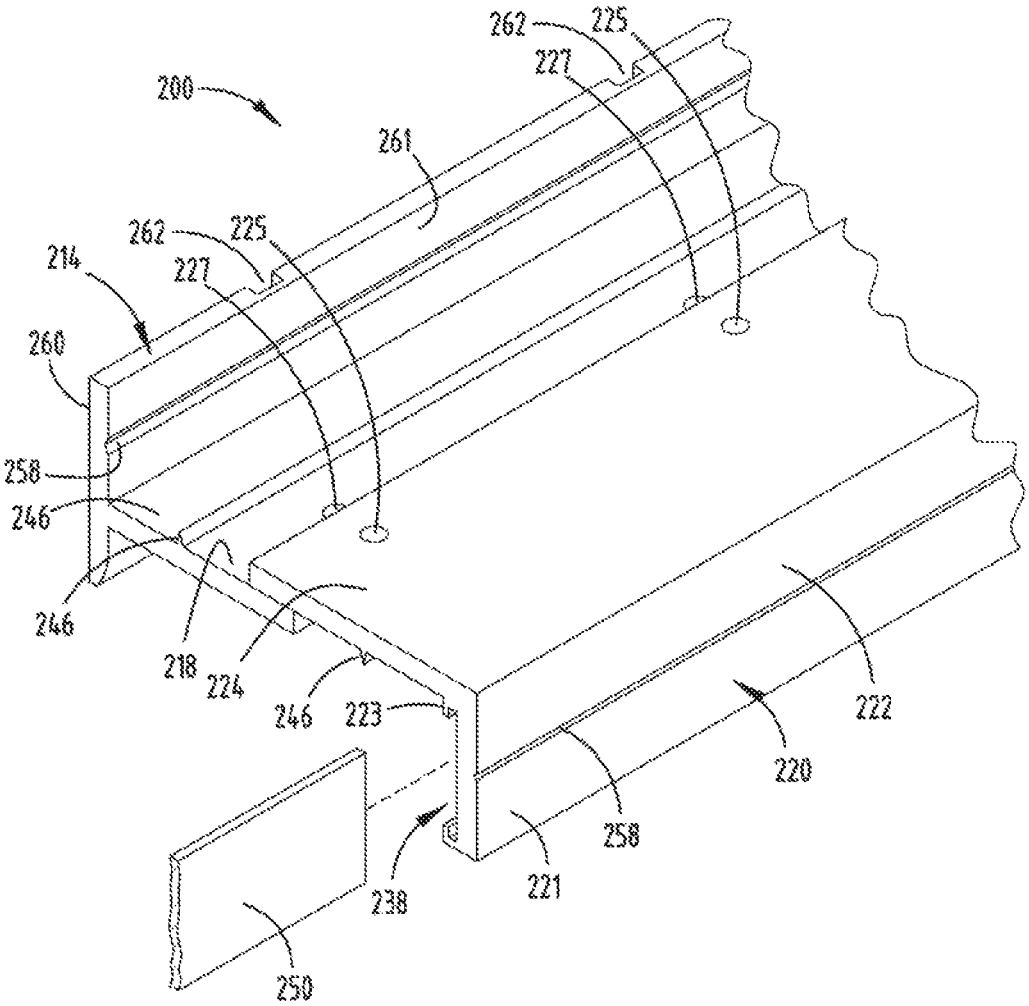
FIG. 19 is a perspective view of another embodiment of an adjustable bracket system.

Referring now to FIG. 19, the anchor member 214 further comprises channels 262 disposed along the interior side 260 of the anchor section 216 wherein the channels 262 vertically span the length of the interior side 260 of the anchor section 216. The channels 262 make up, in part, a ventilation system by providing a cross ventilation air groove for rear ventilating and rain screening of the bracket system 200. The body portion of the connection landing 218 of the anchor member 214 further comprises retention fins or panel piercing airlock ribs 246 which, in this embodiment help to hold insulation panels in place between sets of anchor members and support members 214, 220, such as in the space 240 provided between bracket sets X, Y and Z as shown in FIGS. 17 and 18. It is further contemplated that the insulation panels (not shown) can be manufactured with a channel that corresponds to the fins or ribs 246 of the anchor member 214 to retain the insulation panels in place in assembly, much like insulation panels 104 described above with reference to FIG. 10. In the embodiment shown in FIG. 19, the horizontal connection landing 224 of the support member 220 also comprises a downwardly facing fin or rib 246 for retaining insulation panels in assembly. It is contemplated that both the anchor member 214 and the support member 220 can have retention ribs 246 disposed on the anchor section 216 or support section 222 or the horizontal connection landings 218, 224 as necessary to retain insulation panels in place. In FIG. 19, anchor member 214 and support member 220 are slideably adjustable in their connection in a direction indicated by arrow C along a length of the oblong apertures 227 disposed on horizontal connection landing 218 of anchor member 214.

In the embodiment shown in FIG. 19, the anchor member 214 further comprises channels 258 disposed on the anchor section 216 which are used to guide fasteners in assembly for attaching the anchor member 214 to a substrate of a building structure. Guide channels 258 operate in much the same manner as channels 58 described in reference to FIGS. 5 and 6 above. In the embodiment shown in FIG. 19, the support member 220 also comprises guide channel 258 disposed on an exterior surface 221 of the support section 222 of the support member 220. Support member 220 further comprises a T-shaped channel 238 which is adapted to accept an insert 250 which is used to help retain fasteners in the support section 222 of the support member 220 that are used to connect support member 220 to an exterior cladding unit. T-shaped channel 238 operates much like channel 38 described with reference to FIG. 6 above.

Figure 20:
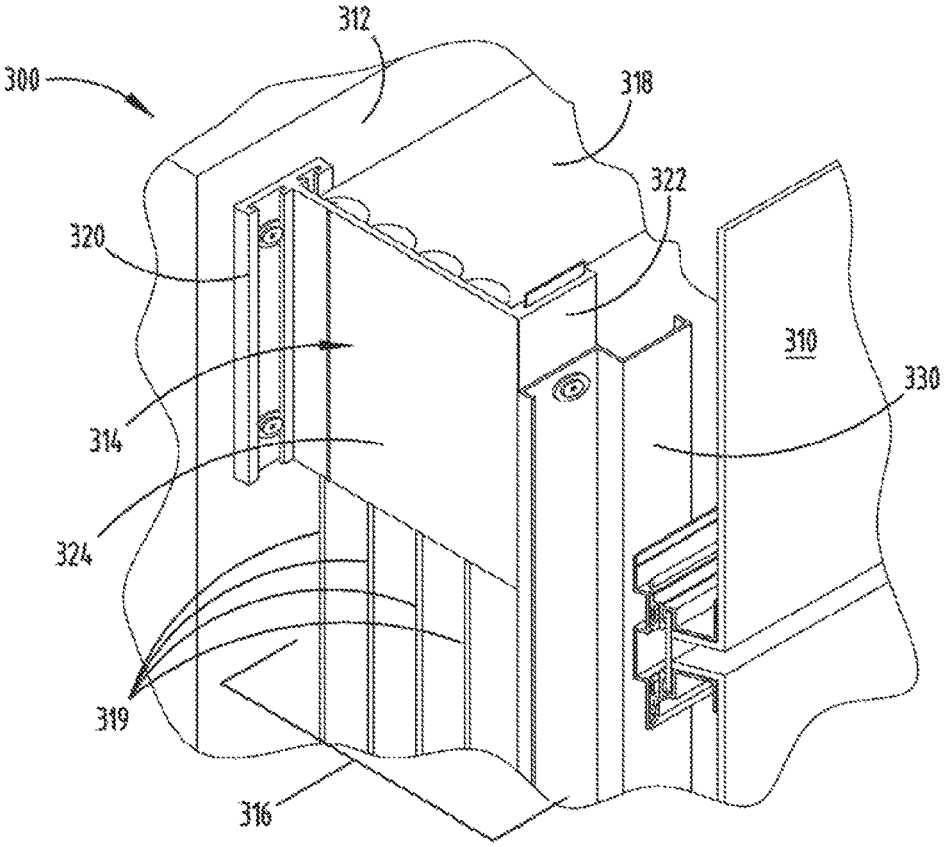
FIG. 20 is a perspective view of a polymeric bracket system according to another embodiment of the present invention.
Figure 21:
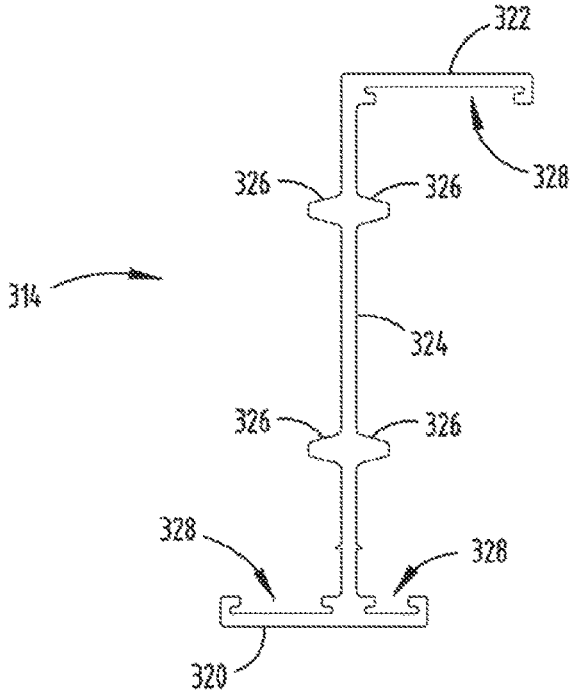
FIG. 21 is a side elevational view of a polymeric bracket.
Figure 22:
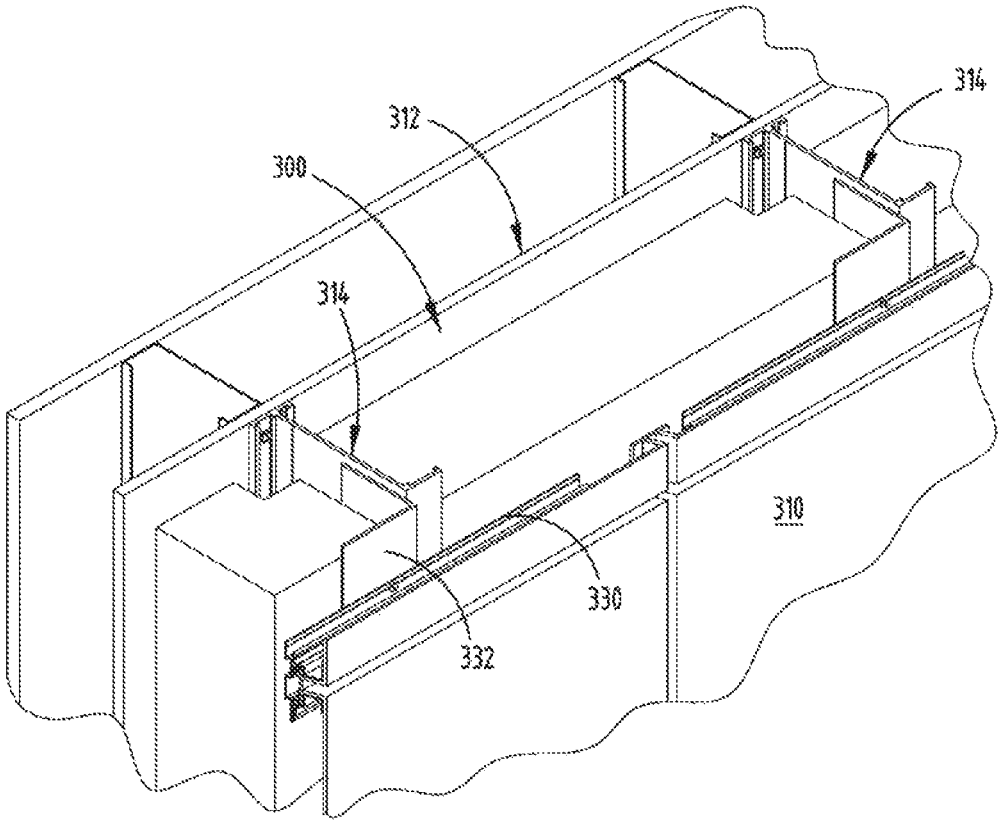
FIG. 22 is a perspective view of a polymeric bracket system according to another embodiment of the present invention.

Referring now to FIGS. 20-22, reference numeral 300 generally indicates a bracket system, or wall construction, according to another embodiment of the present invention. The bracket system 300 includes a cladding unit 310 which is coupled to a building substrate 312 which is shown as a wall substrate, however, it is contemplated that the building substrate can be a roof, a deck, a landing or any other surface disposed on the building structure wherein an exterior cladding system is desired. The bracket system 300 includes a plurality of bracket members 314 which are polymeric bracket members similar to the polymeric bracket members 16 described above. In assembly, the bracket members 314 are used to couple the exterior cladding unit 310 to the building substrate 312. An interior cavity 316 is defined between the building substrate 312 and the exterior cladding unit 310. In the embodiment shown in FIG. 20, a grooved insulation member 318 is disposed within the interior cavity 316 of the bracket system 300. The insulating member 318 comprises grooves 319 which interact with the polymeric brackets 314 as described below. As shown in FIG. 20, the polymeric brackets 314 are separate brackets which are spaced apart along the building substrate 312. Each of the polymeric brackets 314 includes an anchor section 320 and a support section 322. A web portion 324 is disposed between and connects the anchor section 320 with the support section 322.

As best shown in FIG. 21, the polymeric brackets 314 further include retention fins or panel piercing air lock ribs 326 which engage and help retain the insulation panels 318 in assembly. Specifically, the retention fins 326 are adapted to correspond with the grooves 319 disposed on the surface of the insulation panel 318 which contacts the polymeric brackets 314. As further shown in FIG. 21, the polymeric brackets 314 further comprise a plurality of channels 328 disposed on the anchor section 320 and the support section 322 which are adapted to receive a rigidifying. As described above, the rigidifying inserts can be received in channels such as channels 328 which are adapted to retain the inserts therein. Further, it is contemplated that the inserts can be connected to the anchor section 320 or support section 322 by means other than a retaining channel. Other means for receiving a channel at the anchor section 320 or support section 322 include adhering an insert to either section using an adhesive or using a fastener to rigidly connect the insert to either section 320, 322. In assembly, the anchor section 320 is adapted to couple to a building substrate, such as building substrate 312 shown in FIGS. 20 and 22. The support section 322 is adapted to couple to an elongate support member 330 as shown in FIGS. 20 and 22. The elongate support member 330 couples to the support sections 322 of the polymeric brackets 314 which are generally aligned with one another such that the elongate support member 330 forms a surface to which the exterior cladding units 310 are coupled. Thus, the bracket system 300 as shown in FIGS. 20 and 22 does not require full length bracket members that are disposed on and run the entire length of the building substrate 312. In this way, bracket system 300 is a more economical solution and saves on building materials having the bracket members 314 separated and spaced apart along the building substrate 312 as needed to support exterior cladding units. As shown in FIG. 20, the polymeric bracket system 300 is disposed in a vertical manner, such that the elongate support member 330 is vertically configured relative to the building substrate 312. As shown in FIG. 22, the elongate support member 330 is coupled to polymeric bracket members 314 in a horizontal manner. Further, when an elongate member, such as elongate member 330, spans between serially aligned brackets in such a manner that the elongate member couples to the support section of each serially aligned bracket, the elongate member redirects force realized on a bracket by making such forces perpendicular to a corresponding building substrate. Specifically, when an elongate member is coupled to serially aligned polymeric brackets in such a manner that the elongate member is substantially parallel with the direction of the support section of the polymeric bracket, the elongate member eliminates rotational forces which can act on the support portion of a polymeric bracket relative to the web section of the polymeric bracket when such an elongate member is not incorporated into the wall construction. Similarly, as shown in FIGS. 16 and 17, the exterior cladding unit 20 acts in a similar manner to couple serially aligned polymeric brackets such that rotational forces are not realized on the support sections of the polymeric brackets and redirects the forces realized on the polymeric brackets in such a manner that the forces are realized in a perpendicular manner relative to the building substrate. With further reference to FIG. 22, an L-shaped bracket member 332 is coupled to the elongate support member 330 and the polymeric bracket member 314, such that the bracket member 332 can be used as a leveling system to ensure that the elongate support member 330 is equally spaced apart from the building substrate 312 in assembly. In this way, the bracket 332 accounts for variations in the building substrate 312.

Figure 23:
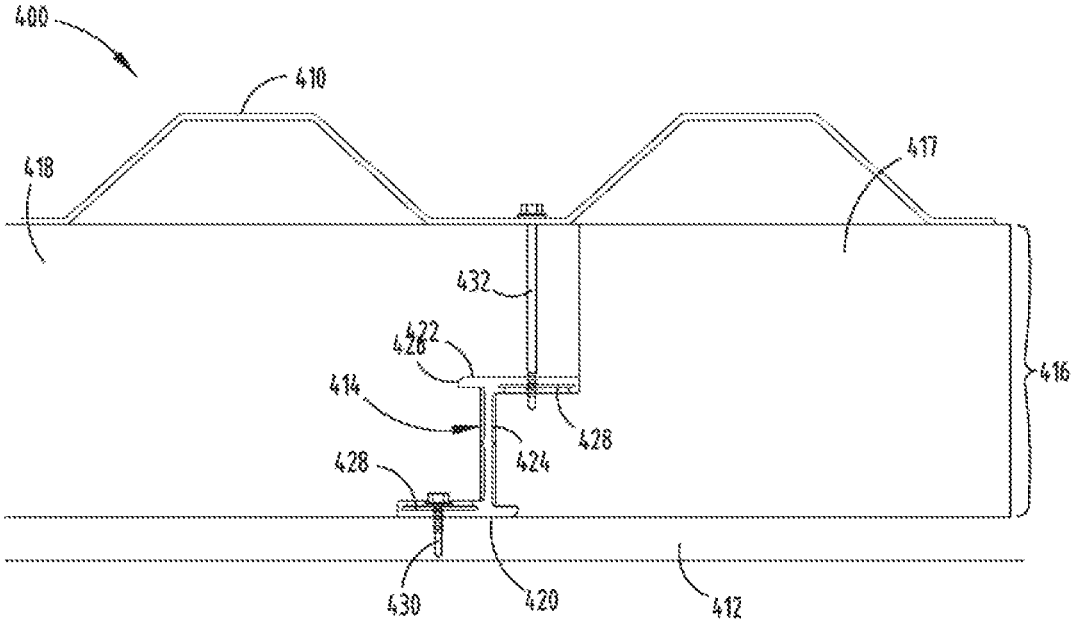
FIG. 23 is a side elevational view of a polymeric bracket system according to another embodiment of the present invention.

Referring now to FIG. 23, the reference number 400 generally indicates a polymeric bracket system for use in conjunction with an exterior cladding unit 410 as coupled to a building substrate 412. In the embodiment depicted in FIG. 23, the polymeric bracket system 400 comprises a polymeric bracket 414 which has a low thermal conductivity that is similar in makeup to the polymeric brackets 16 as described above. The polymeric bracket 414 includes an anchor section 420 and a support section 422 with a web section 424 disposed there between. As shown in FIG. 23, the anchor section 420 and support section 422 further include channels 428 which are adapted to receive rigidifying inserts, such as metal inserts or other inserts which serve to rigidify the polymeric bracket 414 at the anchor section 420 or support section 422. On one end of the web section 424, an insulation retention rib 426 is shown which is adapted to engage an insulating material, such as insulating material members 417 and 418 in assembly. An interior cavity 416 is formed between the exterior cladding unit 410 and the building substrate 412 by the spacing provided by the polymeric bracket 414. As shown in FIG. 23, the anchor section 420 is coupled to the building substrate 412 using a fastener 430 and the support section 422 is coupled to the exterior cladding unit 410 using another fastener 432. With the system 400 as provided in FIG. 23, the support section 422 is internally disposed within the interior cavity 416. As noted above, the polymeric bracket has a generally stepped formation, such that the insulating members 418 also have a generally stepped formation which provides for a more configured fit of the insulating members within the interior cavity 416 adjacent to the exterior building substrate 410 and further adjacent to the polymeric bracket 414. Given the low thermal conductivity of the polymeric bracket 414, a thermal bridge is created from the external environment which is in contact with the exterior cladding unit 410 to the building substrate 412 such that the system 400 is free from thermal bridges that could affect the wall construction or building substrate 412.

Figure 24:
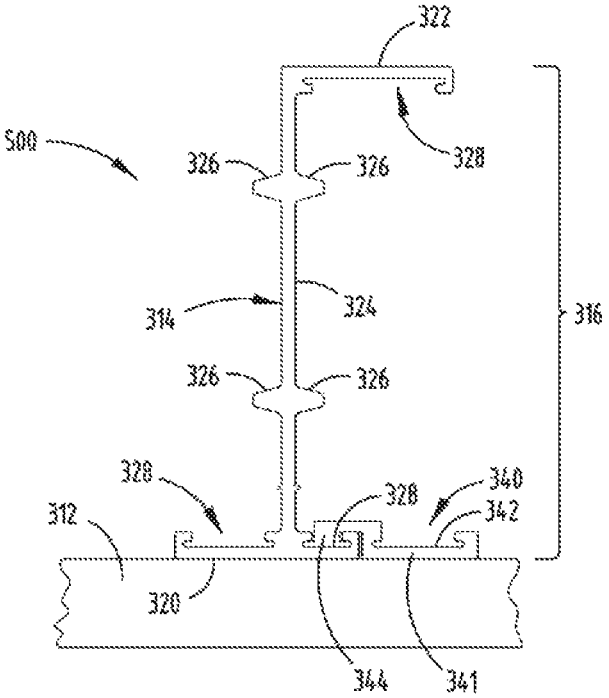
FIG. 24 is a side elevational view of a polymeric bracket system of another embodiment of the present invention.

Referring now to FIG. 24, a polymeric bracket system 500 is shown wherein a polymeric bracket 314, similar to polymeric bracket 314 shown in FIG. 21, is coupled to an elongate support member 340. The elongate support member 340 includes a body portion 341 which is adapted to couple to a building substrate 312. The body portion 341 includes a channel 342 which is adapted to receive a rigidifying insert to aid in the fastening of the elongate support member 340 to the building substrate 312. The body portion 341 is a generally planar body portion as shown in FIG. 24. Extending from the generally planar body portion 341 is a hook shaped connecting portion 344 which in FIG. 24, is generally in the form of a finger extending from the generally planar body portion 341. The connecting portion 344 is adapted to couple to the bracket member 314 at a channel 328 disposed on the anchor portion 320 of the polymeric bracket 314. In this way, the connecting portion 344 is slidably received within the channel 328, such that the polymeric bracket 314 can slide along a length of the connecting portion 344 in assembly. Therefore, the elongate support member 340 is first fastened to a building substrate 312 in assembly. Once in place on the building substrate 312, the elongate support member 340 is adapted to receive a plurality of polymeric brackets 314 which can slide along a length of the connecting portion 344 of the elongate support member 340, such that the polymeric brackets 314 which are slidably coupled to the elongate support member 340 can be positioned as necessary for the coupling of an exterior cladding unit to the support portion 322 of the polymeric brackets 314. As shown in FIG. 24, the bracket system 500 includes an interior spacing 316 which is defined by the spacing between the anchor portion 320 and the support portion 322. It is contemplated that insulating material will be disposed in the interior space 316 in assembly. While the elongate support member 340 is shown having a finger 344 disposed in a channel 328 of the bracket 314, it is contemplated that the bracket 314 can connect to the elongate support member 340 by having a portion of the anchor section 320 overlap with the extending finger 344. Thus, once the bracket member 314 is in place along the elongate support member 340, the bracket member 314 can be rigidly attached thereto using a fastener.

Figure 25:
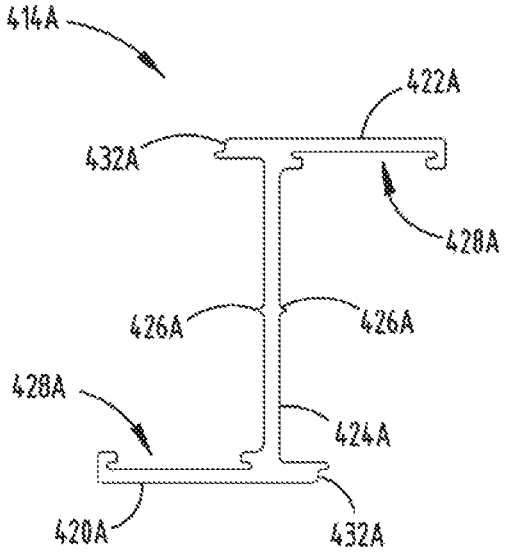
FIG. 25 is a side elevational view of a polymeric bracket of another embodiment of the present invention.
Figure 26:
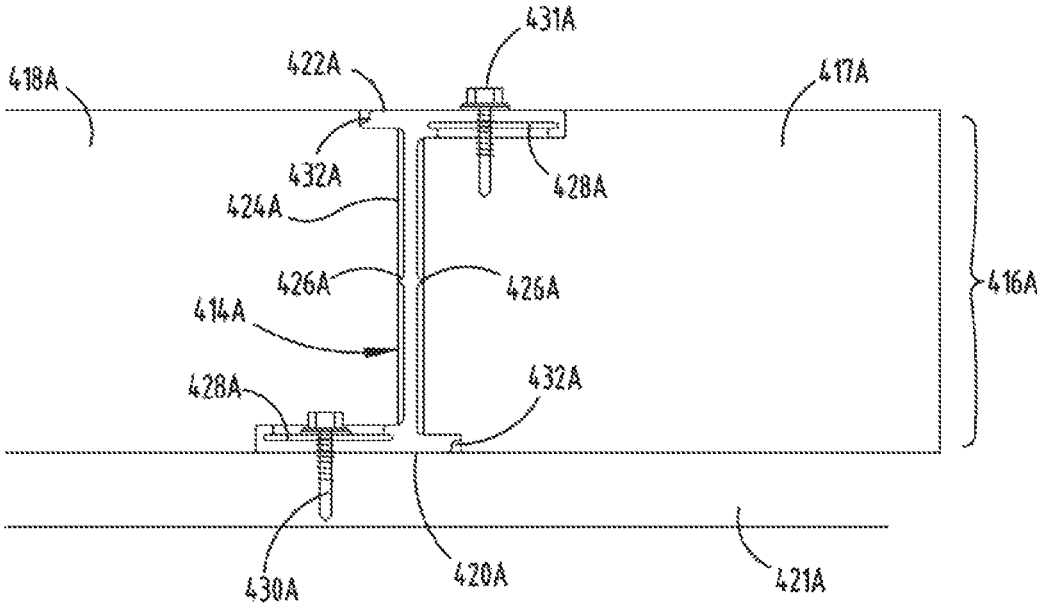
FIG. 26 is a side elevational view of a polymeric bracket system using the bracket of FIG. 25.

Referring now to FIGS. 25 and 26, a polymeric bracket 414A is shown which has a low thermal conductivity similar to the polymeric bracket 16 described above. The polymeric bracket 414A includes an anchor section 420A and a support section 422A with a web section 424A disposed there between. As shown in FIG. 25, the anchor section 420A and support section 422A further include channels 428A which are adapted to receive rigidifying inserts. In assembly, the rigidifying inserts serve to rigidify the polymeric bracket 414A at the anchor section 420A or the support section 422A. The web section 424A includes an insulation retention rib 426A disposed on either side thereof, which are adapted to engage insulation material, such as insulating members 417A and 418A, shown in FIG. 26. An interior cavity 416A is formed between the exterior cladding (not shown) and the building substrate 412 by the spacing provided by the polymeric bracket 414A. A fastener 430A is used to fasten the anchor section 420A to the building substrate 412A, and a like fastener 431A is shown in FIG. 26 as coupled to the support section 422A which is used to couple the polymeric bracket 414A to an exterior cladding unit. Given the low thermal conductivity of the polymeric bracket 414A, a thermal bridge is created from the external environment which is in contact with the exterior cladding unit to the building substrate 412A such that the system 400 is free from thermal bridges that could affect the wall construction or building substrate 412A.

As shown in FIGS. 25 and 26, the support section 422A and the anchor section 420A both include relief portions 432A and 434A which, in assembly, are adapted to break water tension between the building substrate 412 and the exterior cladding unit such that water will gravitationally feed downward along the relief 434A or 432A. In this way, the relief sections 434A, 432A act as anti-capillary action grooves which break the water tension that may otherwise be trapped between an exterior cladding unit and the building substrate 412A, or may otherwise be drawn to joints between insulation members 417A and 418A and the bracket member 414A.

Figure 27:
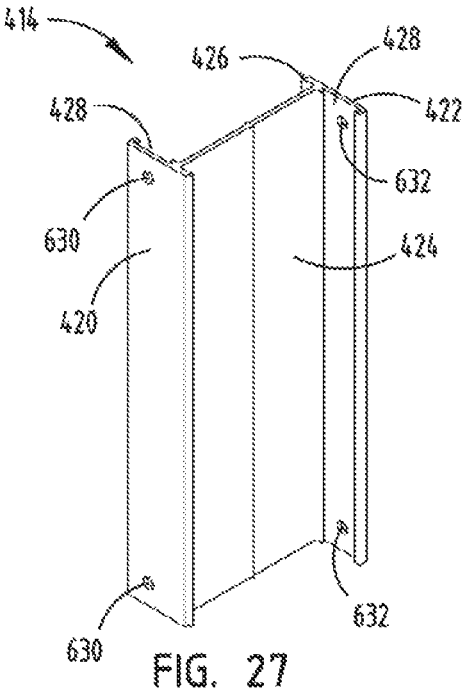
FIG. 27 is a perspective view of a polymeric bracket of another embodiment of the present invention.

Referring now to FIG. 27, a polymeric bracket system is shown comprising a polymeric bracket 614 having an anchor section 620 and a support section 622 which are adapted to couple the polymeric bracket 614 to a building substrate and an exterior cladding unit in a similar manner as described above. Channels 628 are disposed on the anchor section 620 and support section 622 and are adapted to accommodate a rigidifying insert, such as rigidifying insert 640 shown in FIG. 28. Disposed near a terminal end of the polymeric bracket 614 insert apertures 630 and 632 are disposed on the anchor section 620 and support section 622, respectively. In assembly, the insert apertures 630, 632 are adapted to couple to insert engagement features as further described below with reference to FIGS. 28 and 29.

Figure 28:
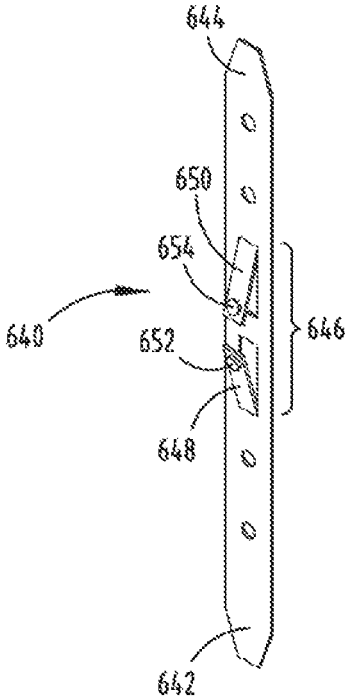
FIG. 28 is a perspective view of a connecting insert.
Figure 29:
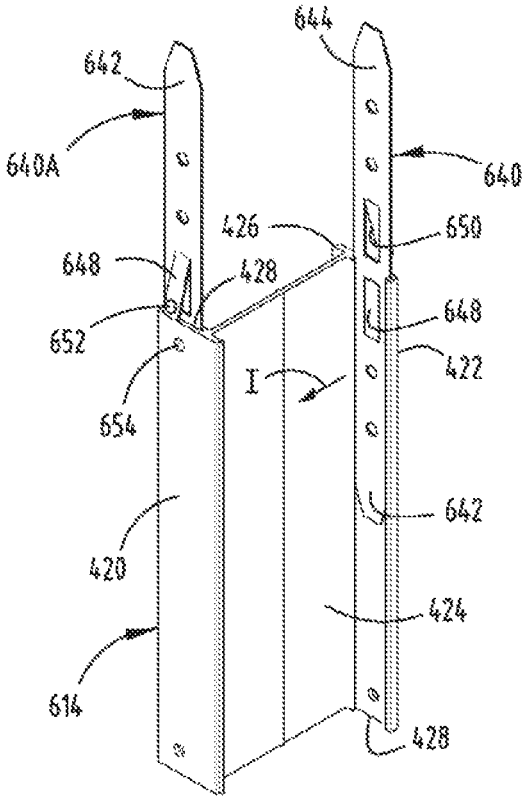
FIG. 29 is a perspective view of the polymeric bracket of FIG. 27 having received multiple connecting inserts.

Referring now to FIGS. 28 and 29, an insert member 640 is shown having a first end 642 and a second end 644 with a central connecting section 646 disposed there between, wherein both the first end 642 and second end 644 are slightly tapered for easier engagement with a bracket member as further described below. As shown in FIG. 28, the first end 642 is longer than the second end 644 which, in assembly, provides a stabilizing configuration for the insert 640 as used with a second insert 640A shown in FIG. 29. As best shown in FIG. 28, the connecting section 646 includes first and second engagement tabs 648 and 650, which are resilient engagement tabs having engagement members 652, 654, respectively. In assembly, the rigidifying insert 640 is adapted to be inserted in either channel 628 of the anchor section 620 or support section 622 of the polymeric bracket 614. Thus, as shown in FIG. 29, the first end 642 of insert 640 has been inserted into channel 628 of the support section 622 of the polymer bracket 614. As the insert 640 is inserted into channel 628 of the support section 622, engagement tab 648 of the insert 640 is forced downward in a direction as indicated by arrow I until engagement member 652 connects with and engages insert aperture 632 thereby locking the insert member 640 in place. As further shown in FIG. 29, a second insert member 640A has been inserted into channel 628 of the anchor section 620 of the polymeric bracket 614, such that the first end 642 extends from the polymeric bracket 614 and the second end 644 is engaged with insert aperture 630 by engagement member 654. In this way, the polymeric bracket 614 shown in FIG. 29 has first and second inserts 640, 640A extending there from, wherein insert 640 has second end 644 extending outwardly while the second insert, 640A, has the first end 642 extending from the polymeric bracket 614. In this way, the first insert 640 has the shorter end 644 extending from the polymeric bracket 614 and the second insert 640A has the longer end 642 extending from the polymeric bracket 614. The differences in length of the extending sections of the inserts 640, 640A provide for a differentiated support structure such that polymeric bracket 614, as shown in FIG. 29, is now adapted to receive another polymeric bracket, similar in configuration to polymeric bracket 614, such that the inserts 640, 640A act as connecting members to connect adjacent polymeric brackets 614 in assembly. Thus, the differentiated lengths of the ends 642, 644 of the inserts 640, 640A allow for a user to first engage the longer end 642 extending from the polymeric bracket 614 and then subsequently engage the shorter end 644 of insert 640. Thus, when a user is looking to connect adjacent polymeric brackets, the user need only align the connecting polymeric bracket with one of the inserts at a time. Thus, the configuration as shown in FIG. 29 makes it easier for a user to connect adjacent polymeric brackets by not making the user align the polymeric bracket with both inserts 640, 640A at the same time.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principals of patent law, including the Doctrine of Equivalents. The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A bracket member for attachment to a building substrate comprising:

a bracket member comprising having an elongated configuration, being a polymer and having a cross-sectional configuration defined by:

a web section having a first end and a second end opposite the first end, and, a first side and a second side, opposite the first side, with the first side extending between the first and second end, and the second side extending between the first and second end opposite the first side;

a support section having an exterior surface and an interior surface, the support section positioned at the first end of the web section and integrally formed therewith, the support section extending to the first side of the web section, the interior surface further defining a channel structurally configured to slidably receive and retain an elongated insert therein; and an anchor section having an exterior side and an interior side, the anchor section positioned at the second end of the web section and integrally formed therewith, the anchor section having a first portion extending to the first side of the web section and a second portion extending to the second side of the web section, the interior side of the first portion defining a first channel structurally configured to slidably receive and retain an elongated insert therein, the interior side of the second portion defining a second channel structurally configured to slidably receive and retain an elongated insert therein wherein the exterior surface of the support section is substantially parallel to the exterior side of the anchor section;

wherein the first side and the second side of the web section are parallel to each other and each perpendicular to the exterior surface of the support section;

wherein the exterior surface and the interior surface are parallel to each other, and wherein the exterior side and the interior side are substantially parallel to each other;

wherein the interior side of the first portion of the anchor section faces the interior surface of the support section; and wherein the first channel defines a first channel width and the second channel defines a second channel width, the second channel width being larger than the first channel width.

2. The bracket member of claim 1 wherein the first channel and the second channel lie within the same plane.

3. The bracket member of claim 1 wherein the support section defines a support section width and the anchor section defines an anchor section width, the support section width being substantially equal to the anchor section width.

4. The bracket member of claim 3 further comprising a first retention fin disposed on the first side of the web portion and a second retention fin disposed on the second side of the web portion opposite the first retention fin, with each retention fin extending away from the respective one of the first side and the second side.

5. The bracket member of claim 4 wherein the first retention fin and the second retention fin are positioned closer to the first end and further from the second end of the web section.

6. The bracket member of claim 3 wherein the web section defines a web section width, wherein the web section width is greater than the support section width and the anchor section width.

7. The bracket member of claim 1 further comprising a plurality of elongated inserts slidably positioned in the support section and the anchor section.

8. The bracket member of claim 7 wherein the plurality of elongated inserts define an insert thickness, the web portion defines a web portion thickness, the anchor section defines an anchor section thickness and the support section defines a support section thickness, wherein the insert thickness is less than the web portion thickness, the anchor portion thickness and the support section thickness.

9. The bracket member of claim 1 wherein the bracket member comprises a fiber reinforced polymer.

10. A bracket member system for attachment to a building substrate comprising:

a bracket member comprising having an elongated configuration, being a polymer and having a cross-sectional configuration defined by:

a web section having a first end and a second end opposite the first end, and, a first side and a second side, opposite the first side, with the first side extending between the first and second end, and the second side extending between the first and second end opposite the first side:

a support section having an exterior surface and an interior surface, the support section positioned at the first end of the web section and integrally formed therewith, the support section extending to the first side of the web section, the interior surface further defining a channel structurally configured to slidably receive an elongated insert therein;

an anchor section having an exterior side and an interior side, the anchor section positioned at the second end of the web section and integrally formed therewith, the anchor section having a first portion extending to the first side of the web section and a second portion extending to the second side of the web section, the interior side of the first portion defining a first channel structurally configured to slidably receive an elongated insert therein, the interior side of the second portion defining a second channel structurally configured to slidably receive an elongated insert therein; and an elongate support member attachable to the bracket member, the elongate support member comprising:

a body further having a connecting portion that is slidably mated with the first channel into engagement, and further defining a elongate support member channel facing the channel of the support section, the elongate support member channel structurally configured to receive an elongated insert therein.

11. The bracket member system of claim 10 wherein the elongate support member channel lies within the same plane as the first channel and the second channel of the anchor section.

12. The bracket member system of claim 10 wherein the body of the elongate support member includes a back wall opposite the elongate support member channel, the back wall lies in the same plane as the exterior side of the anchor section.

13. The bracket member system of claim 12 wherein the back wall has an inner edge, and the second portion of the anchor section has an outer edge, whereupon coupling of the connecting portion with the first channel of the anchor section, the inner edge substantially abuts the outer edge.

* * * * *